US007682230B2

(12) United States Patent
Enomoto

(10) Patent No.: US 7,682,230 B2
(45) Date of Patent: Mar. 23, 2010

(54) COIN HOPPER

(75) Inventor: Minoru Enomoto, Saitama (JP)

(73) Assignee: Asahi Seiko, Co. Ltd., Tokyo (JP)

( * ) Notice: Subject to any disclaimer, the term of this patent is extended or adjusted under 35 U.S.C. 154(b) by 0 days.

(21) Appl. No.: 12/124,574

(22) Filed: May 21, 2008

(65) Prior Publication Data

US 2008/0299886 A1 Dec. 4, 2008

(30) Foreign Application Priority Data

May 28, 2007 (JP) ..... 2007-140947
Sep. 12, 2007 (JP) ..... 2007-236054

(51) Int. Cl.
*G07D 1/00* (2006.01)

(52) U.S. Cl. ..... 453/57

(58) Field of Classification Search ..... 453/18, 453/34, 49, 57

See application file for complete search history.

(56) References Cited

U.S. PATENT DOCUMENTS

| | | | | |
|---|---|---|---|---|
| 2,750,949 | A * | 6/1956 | Kulo | 453/34 |
| 3,942,544 | A | 3/1976 | Breitenstein et al. | |
| 4,036,242 | A * | 7/1977 | Breitenstein et al. | 453/30 |

FOREIGN PATENT DOCUMENTS

| | | |
|---|---|---|
| EP | 0957456 | 11/1999 |
| JP | 59-32836 | 8/1984 |
| JP | 03-187288 | 7/2003 |
| JP | 2003-187288 | 7/2003 |

OTHER PUBLICATIONS

English language Abstract JP 2003-187288.

* cited by examiner

*Primary Examiner*—Patrick Mackey
*Assistant Examiner*—Mark Beauchaine
(74) *Attorney, Agent, or Firm*—Greenblum & Bernstein, P.L.C.

(57) ABSTRACT

A coin hopper includes a rotating disk provided obliquely upward at a predetermined angle; an outer covering unit covering at least a lower outer circumference of the rotating disk; a holding bowl continuing from the outer covering unit and holding coins; a circular supporting rack provided in a central region of an upper surface of the rotating disk; and coin stoppers being provided on the upper surface of the rotating disk and extending radially from the supporting rack in a circumferential direction to a periphery of the rotating disk at an equal interval. Coins are accepted one by one while a surface thereof is contacted with a holding surface of the upper surface of the rotating disk between the coin stoppers, are moved in one direction while a periphery thereof is held by the supporting rack, and are received from the coin stoppers during transportation by a coin receiver.

9 Claims, 29 Drawing Sheets

(A)

(B)

(A)

(B)

(A)

(B)

(A)

(B)

(A)

(B)

(A)

(B)

(A)

(B)

COIN HOPPER

CROSS-REFERENCE TO RELATED APPLICATIONS

The present application claims priority under 35 U.S.C. §119 of Japanese Application No. 2007-140947 filed on May 28, 2007 and No. 2007-236054 filed on Sep. 12, 2007, the disclosures of which are expressly incorporated by reference herein in their entireties.

BACKGROUND OF THE INVENTION

1. Field of the Invention

The present invention relates to a coin hopper that sorts and discharges coins one by one, the coins being held in bulk in a holding bowl. Specifically, the present invention relates to a coin hopper capable of sorting and discharging coins one by one, the coins having different diameters and being held in bulk in a holding bowl. More specifically, the present invention relates to a coin hopper capable of surely feeding out, one by one, coins having different diameters. Coins herein include currencies, medals and tokens for game machines, and the like.

2. Description of Related Art

As a first conventional technology, a coin hopper is known capable of sorting and discharging coins one by one, the coins having different diameters and being held in bulk in a holding bowl. In the coin hopper, a circular supporting rack is provided that projects from a central region of an upper surface of a rotating disk provided obliquely upward; coin stoppers are provided radially from the supporting rack side and slidably relative to the rotating disk surface; and a coin receiving knife is provided at a predetermined location. Coins, which are supported by the supporting rack and pushed by the coin stoppers, are received by the receiving knife toward a circumference of the rotating disk. After receiving the coins, the receiving knife pushes the coin stoppers into the rotating disk for retraction (Refer to Patent Document 1).

As a second conventional technology, a coin hopper is known in which coins are pushed one by one by coin stoppers, while a periphery of a coin is contacted with a circular supporting rack and a surface of the coin is contacted with a holding surface in a location between the coin stoppers; the coin stoppers being provided on an upper surface of a rotating disk and extending radially from the supporting rack side in a circumferential direction at an equal interval; the circular supporting rack being provided in a central region of the upper surface of the rotating disk provided obliquely upward at a predetermined angle, and projecting for an amount equal to or less than a thickness of one coin; the holding surface being the upper surface of the rotating disk. While being pushed, the coins are received from the coin stoppers by a coin receiver, which extends from a vicinity of the supporting rack in the circumferential direction of the rotating disk. A planar wiper is provided to drop coins which are moved forward while overlapping, the planar wiper being provided opposite to the upper surface of the rotating disk, at a distance of a thickness of one coin or more and two coins or fewer (Refer to Patent Document 2).

In a third conventional technology, coins are pushed in a predetermined direction by a projection provided on an upper surface of an oblique disk while a periphery of a coin is contacted with a boundary peripheral portion, which is provided in a central region of the oblique disk and projects for an amount equal to or less than a thickness of a coin. While being moved, the coins are dropped by a thickness regulating lever so that one coin is fed to a next process. The thickness regulating lever is swingably pivoted on a supporting shaft and provided relative to the oblique disk at an interval of a thickness of one coin or more and two coins or fewer (Refer to Patent Document 3).

[Patent Document 1] Specification of European Patent Application Publication No. 0957456 (FIGS. 1 to 7; Pages 2 to 4)

[Patent Document 2] Japanese Patent Publication No. S59-32836 (FIGS. 3 and 9; Page 6)

[Patent Document 3] Japanese Patent Laid-open Publication No. 2003-187288 (FIG. 1; Page 6)

In the first conventional technology, the coin stoppers, which are provided as eight pieces of planar bodies, for example, are provided radially at an equal interval and extend to the periphery of the rotating disk. The coin stoppers are elastically biased so as to project from the rotating disk surface. After the coin stoppers transfer coins to the receiving knife, which has an even thickness substantially identical to the thickness of coins, the coin stoppers are pushed into the rotating disk by the receiving knife for retraction. The coin hopper is capable of discharging coins which are supported by the supporting rack at the periphery and are held between the coin stoppers, thereby capable of discharging coins having diameters within a predetermined range. In addition, the coin stoppers, which extend to the periphery of the rotating disk, allow coins to spring out after passing an inclined portion of the receiving knife and in substantially a horizontal portion. Thus, the coin hopper can be set to discharge coins in a lateral direction. Further, the receiving knife, which has an even thickness substantially identical to the thickness of coins, stabilizes the position of coins being guided, and thus prevents the coins from inadvertently dropping down. When two coins overlap, the coins start sliding on the rotating disk due to gravity at substantially a one o'clock position of a clock. Then, a lower periphery of a lower coin is supported by the supporting rack, but a lower periphery of an upper coin is not supported thereby. Thus, the upper coin free-falls due to gravity, and one coin is separated and fed out. The coin hopper may feed two coins when a rotation speed of the rotating disk is increased in order to increase a discharge count of coins per predetermined time. The event occurs because the increased rotation speed of the rotating disk increases a centrifugal force exerted on coins, which are then supported by the supporting rack at substantially a 12 o'clock position when dropping due to own weight. Then, the overlapping coins are received by the receiving knife having a thickness of one coin or greater while two coins overlap.

In order to prevent two coins from being fed out, it is considered to combine the wiper of the second conventional technology or the thickness regulating lever of the third conventional technology with the first conventional technology. When the second conventional technology is combined, it is considered that the wiper is provided in a location opposite to the upper surface of the rotating disk at a distance of a maximum coin thickness or greater and twice a minimum coin thickness or less. In this case, the wiper is provided on a rotation path of the coin stoppers. In order to avoid interference with the wiper, the coin stoppers cannot be extended to the periphery of the rotating disk, since the coin stoppers are formed slightly higher than the maximum coin thickness even when being formed low so as to prevent the thickest coin from escaping. Conversely, when the coin stoppers are formed low so as to pass below the wiper, the coin stoppers and the wiper may interfere, in a case such as where the wiper is bent when a coin is placed thereon. When the coin stoppers are not extended to the periphery of the rotating disk, coins are discharged in an obliquely upper direction since the coins are sprung out from the inclined portion of the receiving knife. Thus, the coin hopper has a limitation in installation in game machines, and thus cannot be applied immediately.

When the third conventional technology is combined, it is necessary to avoid interference between the coin stoppers and the thickness regulating lever, since the diameter regulating lever is provided on a moving path of the coin stoppers. Specifically, when the coin stopper contacts the regulating lever, the coin stopper is pushed by the regulating lever and retracted into the rotating disk, whereas when the coin stopper does not contact the regulating lever, the coin stopper projects on the upper surface of the rotating disk. In a rare case, a customer may insert a stick or the like along with coins into a coin insertion slot. When the coin stoppers are movably provided as described above, the inserted stick may be caught in a projection/retraction hole of the coin stopper, which thus is unable to move as being held in a retracted position. When the coin stopper is continuously held in the retracted position, the coin stopper cannot stop coins, thus coins may not be discharged evenly. In an extreme case where all coin stoppers are held in the retracted position, coins cannot be discharged. In addition, in the third conventional technology, the diameter regulating lever pushes coins against the boundary peripheral portion so as to limit one coin in a diameter direction. In other words, when an upper coin of overlapping coins is pushed by the diameter regulating lever, the coin is not supported by the boundary peripheral portion and thus drops down. Thereby, one coins is separated. When the rotating disk is rotated reversely in order to fix a coin jam and the like, however, a contact location of a coin forms an acute angle relative to the supporting shaft of the diameter regulating lever. The coin is thus pinched between the diameter regulating lever and the coin stopper, and the rotating disk cannot be reversed. Thus, the technology cannot be applied immediately. In addition, when the rotating disk is not rotated because a coin is pinched even though a driving voltage is applied to an electric motor for driving the rotating disk, the electric motor may be overheated, thus leading to fire. Thus, it is required to check rotation of the rotating disk when the driving voltage is applied to the electric motor.

SUMMARY OF THE INVENTION

A first feature of the present invention is to provide a coin hopper capable of discharging coins having different diameters with no trouble even when a coin discharging speed is increased. A second feature of the present invention is to provide a coin hopper that does not pinch coins even when a rotating disk for discharging coins is rotated reversely. A third feature of the present invention is to provide a coin hopper that enables a coin discharging speed to increase and a rotating disk for discharging coins to rotate reversely. A fourth feature of the present invention is to provide a coin hopper that ensures separation of coins one by one and feeding thereof using a rotating disk. A fifth feature of the present invention is to provide a coin hopper capable of detecting rotation of a rotating disk using a simple device.

A first aspect of the present invention provides a coin hopper that includes a rotating disk being provided obliquely upward at a predetermined angle; an outer covering unit covering at least a lower outer circumference of the rotating disk; a holding bowl continuing from the outer covering unit and holding coins in bulk; a circular supporting rack being provided in a central region of an upper surface of the rotating disk and projecting for a thickness of substantially one coin; and coin stoppers being provided on the upper surface of the rotating disk and extending radially from the supporting rack in a circumferential direction to a periphery of the rotating disk at an equal interval. Coins are accepted one by one while a surface thereof is contacted with a holding surface of the upper surface of the rotating disk between the coin stoppers, are moved in one direction while a periphery thereof is held by the supporting rack, and are received from the coin stoppers during transportation by a coin receiver extending from a vicinity of the supporting rack in the circumferential direction of the rotating disk. A dropper is provided upstream of the coin receiver, the dropper biasing coins toward the supporting rack above the center of the rotating disk and preventing hitting the coin stoppers.

A second aspect of the present invention provides a coin hopper, in which the dropper includes a first circumferential pressing portion and a second circumferential pressing portion. The first circumferential pressing portion is movable in parallel relative to the upper surface of the rotating disk in a space wider than a thickness of a thickest coin, and prevents hitting the coin stoppers. The second circumferential pressing portion is movable in parallel relative to the upper surface of the rotating disk at a distance exceeding the thickness of the thickest coin and greater than the first circumferential pressing portion, and remains in a position opposite to the upper surface even when the first circumferential pressing portion is not positioned opposite to the upper surface in order to prevent the hitting.

A third aspect of the present invention provides a coin hopper, in which the first circumferential pressing portion and the second circumferential pressing portion are integrally provided.

A fourth aspect of the present invention provides a coin hopper, in which the dropper is retracted by a cam provided on the rotating disk, so as not to contact the coin stoppers.

A fifth aspect of the present invention provides a coin hopper, in which the cam is a circumferential cam provided on a rear surface side of the rotating disk.

A sixth aspect of the present invention provides a coin hopper, in which the cam includes an apex portion and ride-on portions, the apex portion being provided opposite to the coin stopper and farthest from a rotation center, the ride-on portions being provided on both sides of the apex portion and having substantially an equal inclination angle.

A seventh aspect of the present invention provides a coin hopper, in which the dropper is provided integrally with a lever and has a planar shape, the lever being rotatably pivoted on a pivot shaft provided external to the periphery of the rotating disk, the planar shape extending orthogonally relative to the upper surface of the rotating disk.

An eighth aspect of the present invention provides a coin hopper, in which the second circumferential pressing portion includes a crescent-shaped edge that comes into contact with a periphery of a medal supported by the rotating disk.

A ninth aspect of the present invention provides a coin hopper, in which a detector is provided that detects a movement of the first circumferential pressing portion.

Coins held in bulk in the holding bowl move toward the rotating disk provided obliquely upward at a predetermined angle due to inclination of a bottom wall of the holding bowl, and contact the upper surface of the rotating disk with a predetermined contact pressure. The coins in bulk are agitated by the coin stoppers projecting on the upper surface of the rotating disk and stopped by the coin stoppers. The coins then come into surface contact with the holding surface between the coin stoppers. When coins whose surface is in contact with the upper surface of the rotating disk are located below the horizontal line, the coins are guided by the outer covering unit that covers at least the lower outer circumference of the rotating disk. Meanwhile, when the coins are located above the horizontal line, gravity causes the coins to roll on the coin stoppers toward the center supporting rack according to the inclination of the coin stoppers. When a rotation speed of the rotating disk is higher than a predetermined value, a centrifugal force exerted to coins offsets a downward dropping force by gravity, and thus the coins do not move toward the supporting rack until the coins are located proximate to a 12 o'clock position. In the present invention, the dropper is retractably projected on a coin moving path. Thus, the outer circumference of the coins, which are pushed by the coin stoppers, is forcibly moved by the dropper relatively toward the supporting rack. The coins whose surface is in contact with the holding surface are pressed against the supporting rack and held thereby. A coin placed on the coin whose surface is in contact is not supported by the supporting rack, and thus drops down toward a central portion of the rotating disk. Thereby, the coins are received one by one between the coin stoppers. The coins supported by the supporting rack and pushed by the coin stoppers are received by the receiver and discharged. In the present invention, the coin stoppers are fixedly provided on the rotating disk. In other words, the coin stoppers do not move relative to the rotating disk, thus causing no problem of being held in a retracted position by a stick or the like. Thereby, the coin hopper can surely discharge coins having different diameters.

In the second aspect of the present invention, an outer circumference of a coin, which is pushed by the coin stoppers, is forcibly moved by the first circumferential pressing portion relatively toward the supporting rack. The circumference of the coin whose surface is in contact with the holding surface is pressed against the supporting rack and held thereby. A coin placed on a coin whose surface is in contact with the holding surface of the rotating disk is not supported by the supporting rack, and thus drops down toward the central portion of the rotating disk. Thereby, coins are received one by one between the coin stoppers. In addition, the coin which is placed on an upper surface side of the coin whose surface is in contact with the holding surface and is moved concurrently with the surface contacting coin due to inertia force, is pressed relatively toward the supporting rack by the second circumferential pressing portion, and thus cannot reach the coin receiver. Coins supported by the supporting rack and pushed by the coin stoppers are received by the receiver and discharged. Thereby, the coin hopper can surely sort and discharge, one by one, coins having different diameters.

In the third aspect of the present invention, the first circumferential pressing portion and the second circumferential pressing portion of the dropper are integrally provided. It is thus unnecessary to provide a supporter, a driver, and other components separately for the first circumferential pressing portion and the second circumferential pressing portion. Thereby, the structure is simplified, and the apparatus is downsized and inexpensively manufactured.

In the fourth aspect of the present invention, the dropper is retracted by the cam provided on the rotating disk, so as not to contact the coin stoppers. Thereby, the coin stoppers do not come into contact with the dropper, which is retracted by the cam, thus preventing wear of the coin stoppers.

In the fifth aspect of the present invention, the cam, which moves the dropper so as to avoid contact with the coin stoppers, is the circumferential cam integrally provided on the rear surface of the rotating disk. Since the circumferential cam is provided integrally with the rotating disk, the cam requires little space and allows downsizing of the apparatus.

In the sixth aspect of the present invention, the circumferential cam, which forcibly moves the dropper so as to avoid contact with the coin stoppers, is provided with substantially an equal angle on both sides of the apex portion. Thus, even when the rotating disk is rotated reversely, the dropper can be retracted so as not to contact the coin stoppers, similar to a case of forward rotation. Thereby, the rotating disk can be reversed. In cases of a coin jam or where a last one coin cannot be stopped by the coin stoppers when a few coins remain, the rotating disk is temporarily rotated reversely, and then forward, so as to fix the coin jam or to automatically discharge coins to the last one.

In the seventh aspect of the present invention, the dropper has a planar shape and extends to the upper surface of the rotating disk forming a visor shape. Even when several coins overlap, the dropper guides the coins so as to drop down in the holding bowl, thus preventing two coins from being fed.

In the eighth aspect of the present invention, the second circumferential pressing portion has a planar shape and extends to the upper surface of the rotating disk forming a visor shape. In addition, the second circumferential pressing portion is provided opposite to the upper surface of the rotating disk, even when the first circumferential pressing portion is not provided opposite thereto. Thus, even when several overlapping coins are provided, the second circumferential pressing portion guides the coins so as to drop down in the holding, thereby preventing two coins from being fed concurrently and a coin from being pinched.

In the ninth aspect of the present invention, when the rotating disk is rotated, the first circumferential pressing portion is periodically retracted by the circumferential cam that rotates concurrently with the rotating disk. A movement of the first circumferential pressing portion is detected by the detector, which periodically outputs a detection signal. Thus, when the detector does not periodically output a detection signal, the detector outputs an abnormal signal so as to stop supplying the power to the electric motor to prevent the electric motor from being overheated.

A coin hopper includes a rotating disk being provided obliquely upward at a predetermined angle; an outer covering unit covering at least a lower outer circumference of the rotating disk; a holding bowl continuing from the outer covering unit and holding coins in bulk; a circular supporting rack being provided in a central region of an upper surface of the rotating disk and projecting for a thickness of substantially one coin; and coin stoppers being provided on the upper surface of the rotating disk and extending radially from the supporting rack in a circumferential direction to a periphery of the rotating disk at an equal interval. Coins are accepted one by one while a surface thereof is contacted with a holding surface of the upper surface of the rotating disk between the coin stoppers, are moved in one direction while a periphery thereof is held by the supporting rack, and are received from the coin stoppers during transportation by a coin receiver extending from a vicinity of the supporting rack in the circumferential direction of the rotating disk. A circumferential cam is provided integrally with the rotating disk on a rear surface thereof. The circumferential cam includes an apex portion opposite to the coin stopper, the apex portion being provided on both sides with a same inclination angle so as to form a petal shape. A dropper is provided upstream of the coin receiver, the dropper biasing coins toward the supporting rack above the center of the rotating disk and preventing hitting the coin stoppers. The dropper is provided integrally with a lever and has a planar shape, the lever being rotatably pivoted on a pivot shaft provided external to the periphery of the rotating disk, the planar shape extending orthogonally relative to the upper surface of the rotating disk. A cam follower provided with the lever is elastically pressed against the circumferential cam.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

Figure 1:
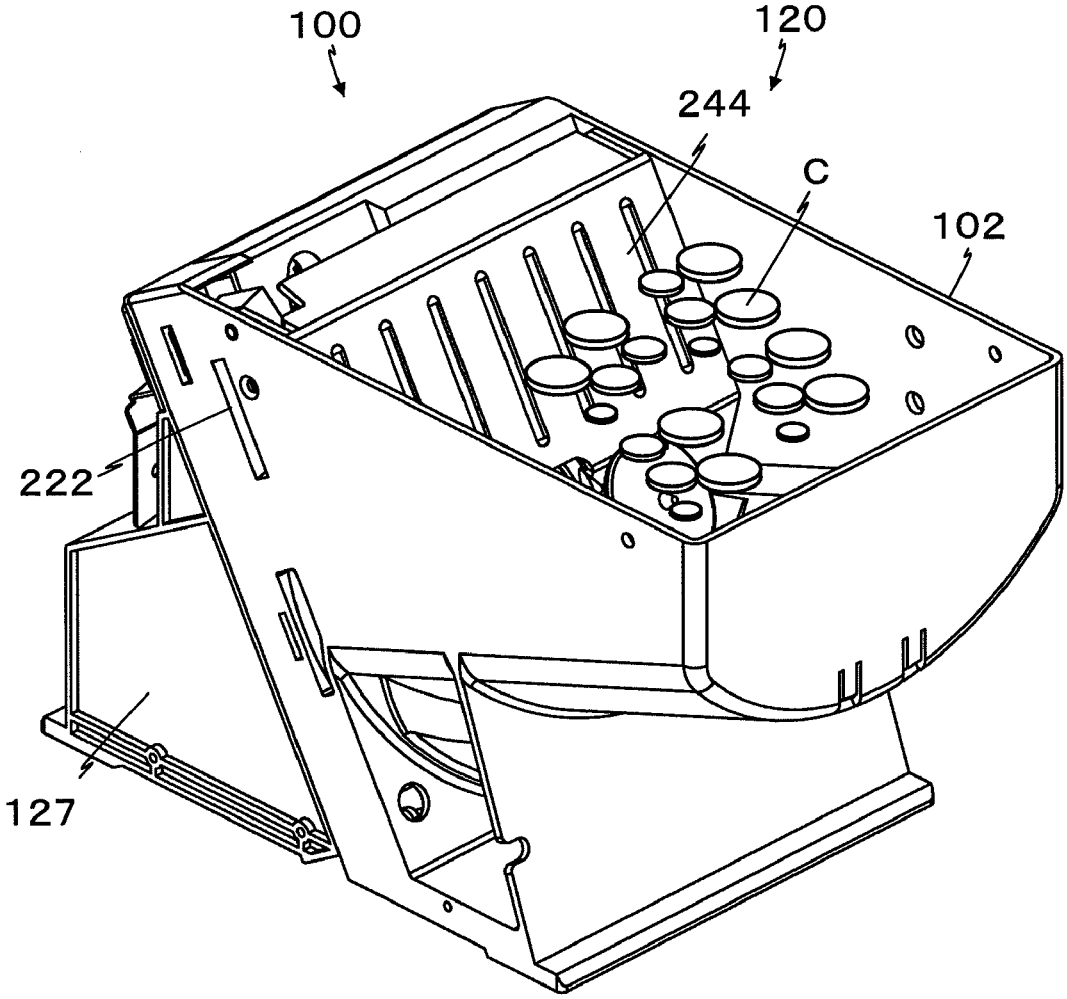
FIG. 1 is an overall perspective view of a coin hopper according to a first embodiment of the present invention.
Figure 2:
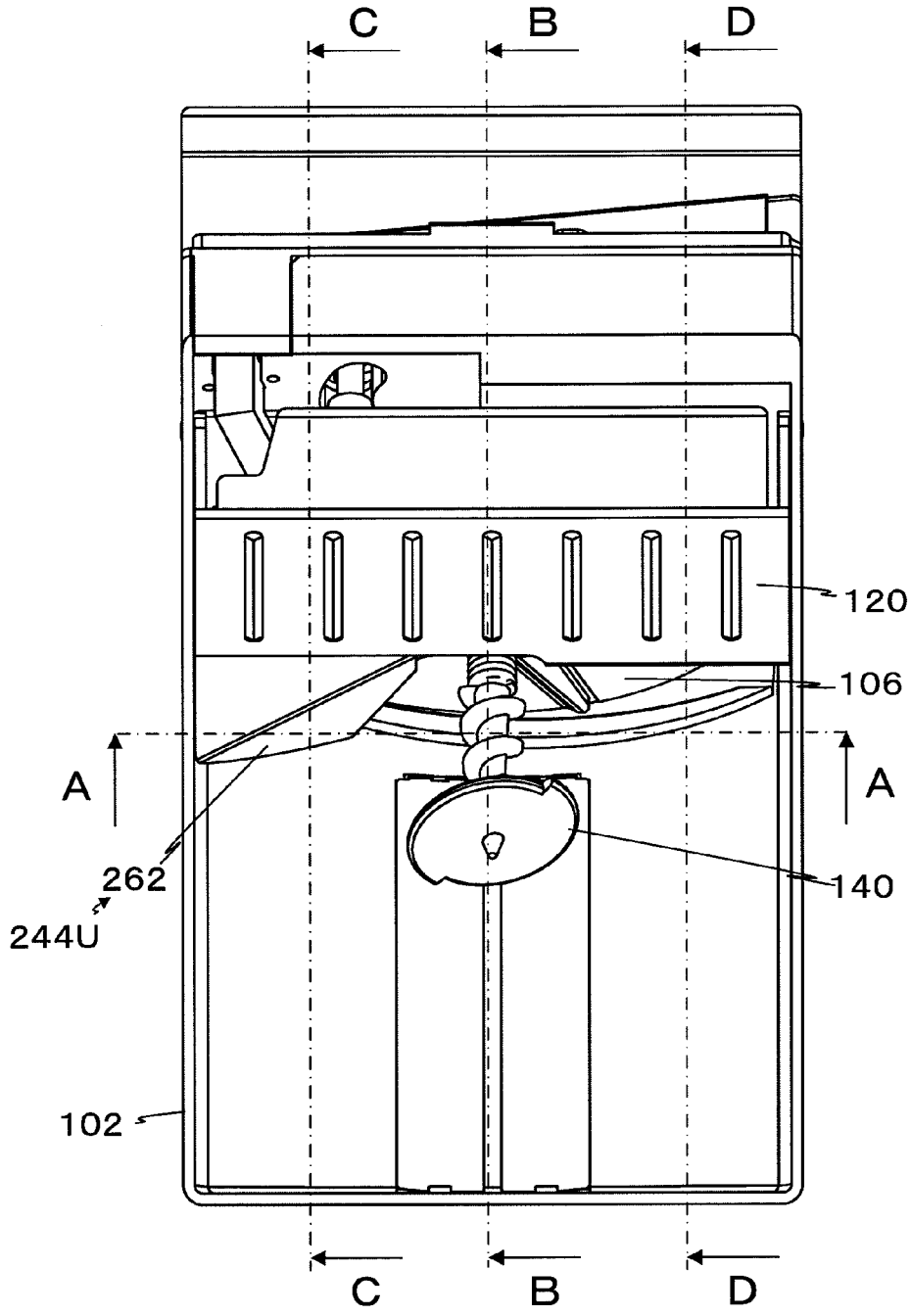
FIG. 2 is a plane view of the coin hopper according to the first embodiment of the present invention.
Figure 3:
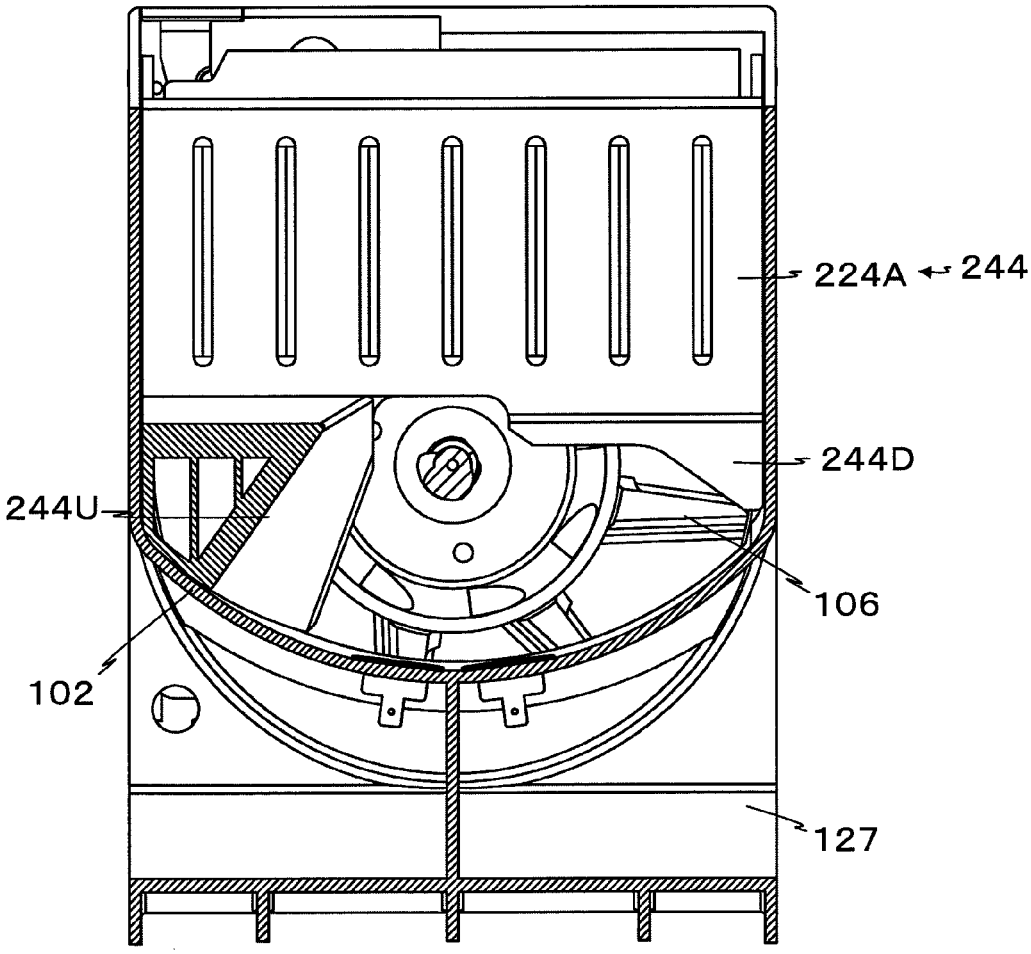
FIG. 3 is a cross-sectional view of the coin hopper according to the first embodiment of the present invention, when the coin hopper is cut along a surface parallel to a rotating disk on line A-A in FIG. 2.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

First Embodiment

As shown in FIGS. 1, 4, 5, and 10, a coin hopper 100 includes a holding bowl 102, which holds numerous coins in bulk; an attachment base 104 (see FIG. 10), which supports and fixes the holding bowl 102 obliquely upward; a rotating disk 106, which sorts coins C one by one; a driver 108 of the rotating disk 106; a receiver 112 of coins C; a hopper 114 of coins C; a detector 116 of coins C; and a dropper 118 of coins C according to the present invention; and a regulator 120 of coins C.

Figure 5:
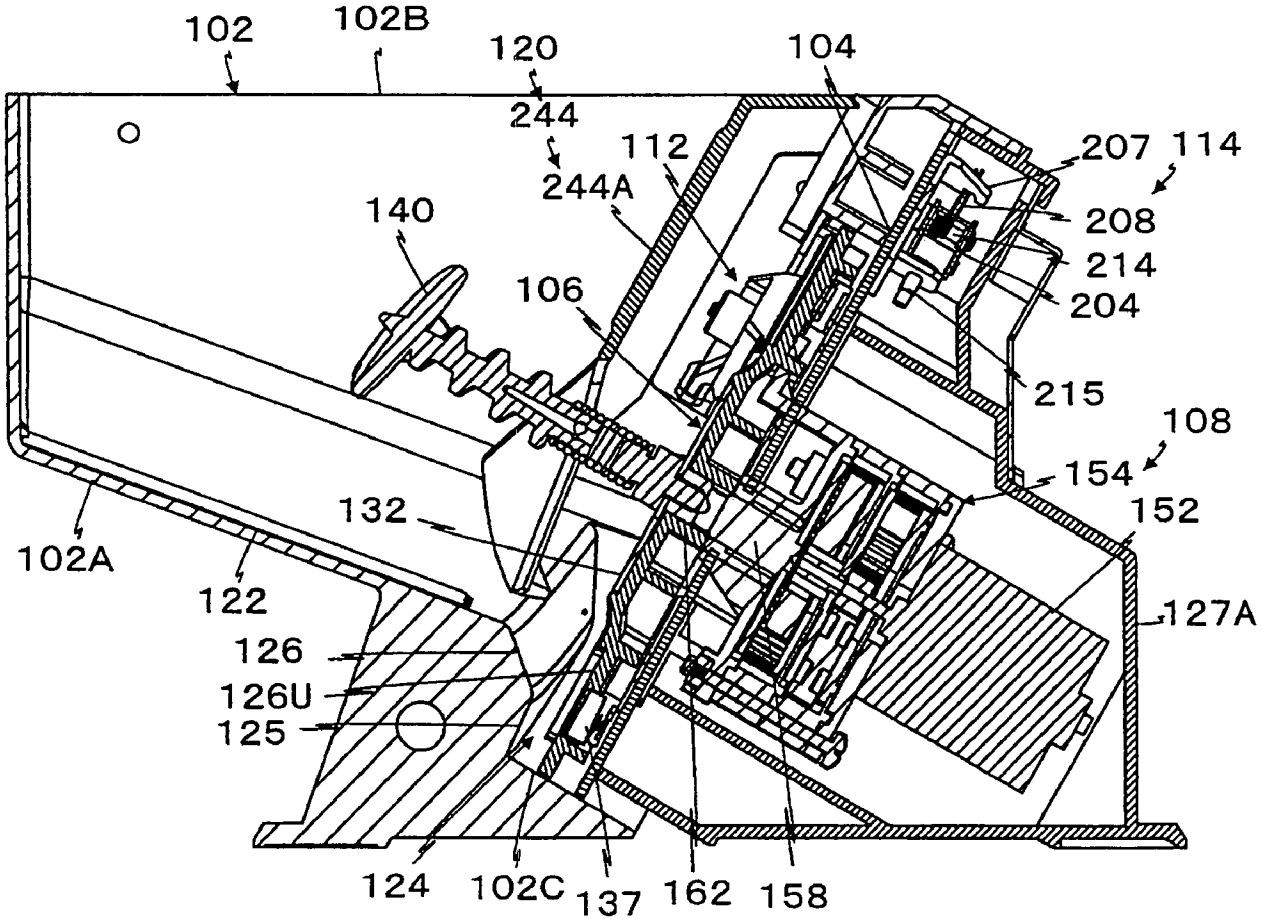
FIG. 5 is a cross-sectional view of the coin hopper along line B-B in FIG. 2.
Figure 6:
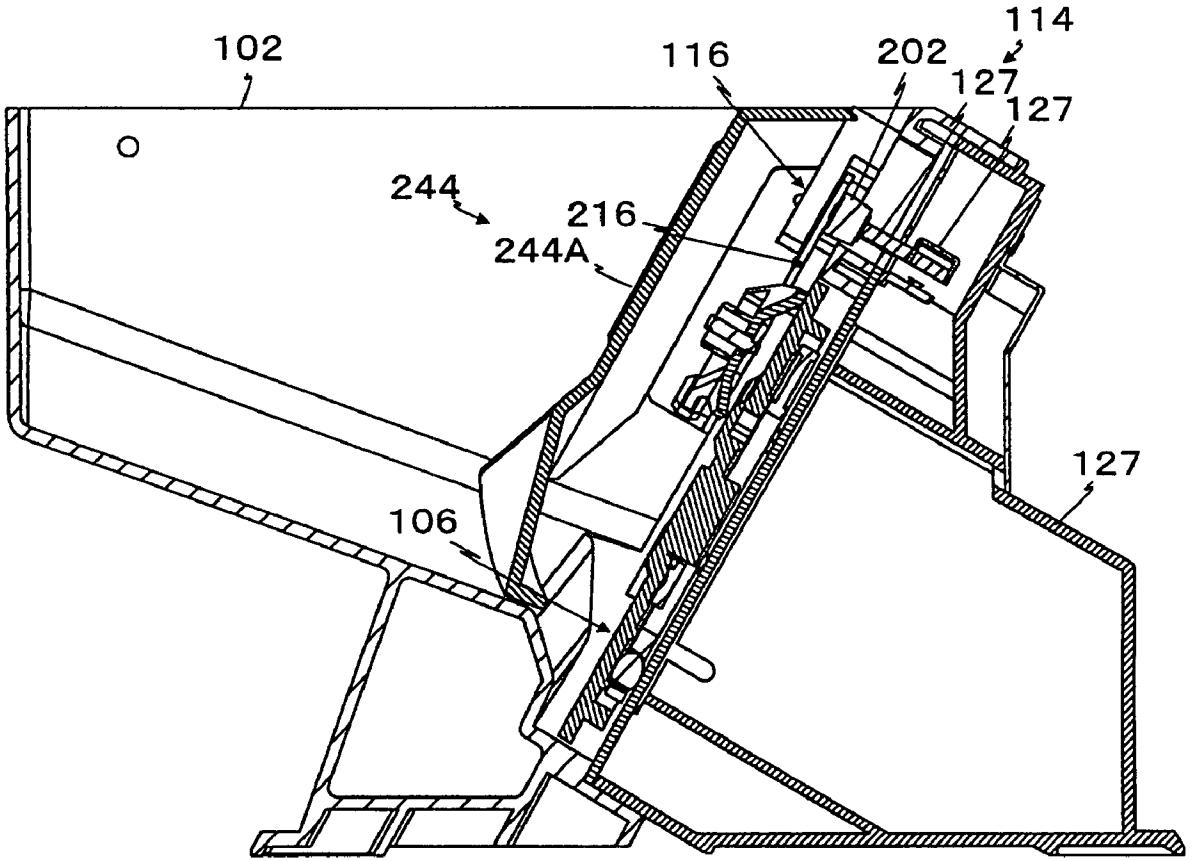
FIG. 6 is a cross-sectional view of the coin hopper along line C-C in FIG. 2.
Figure 7:
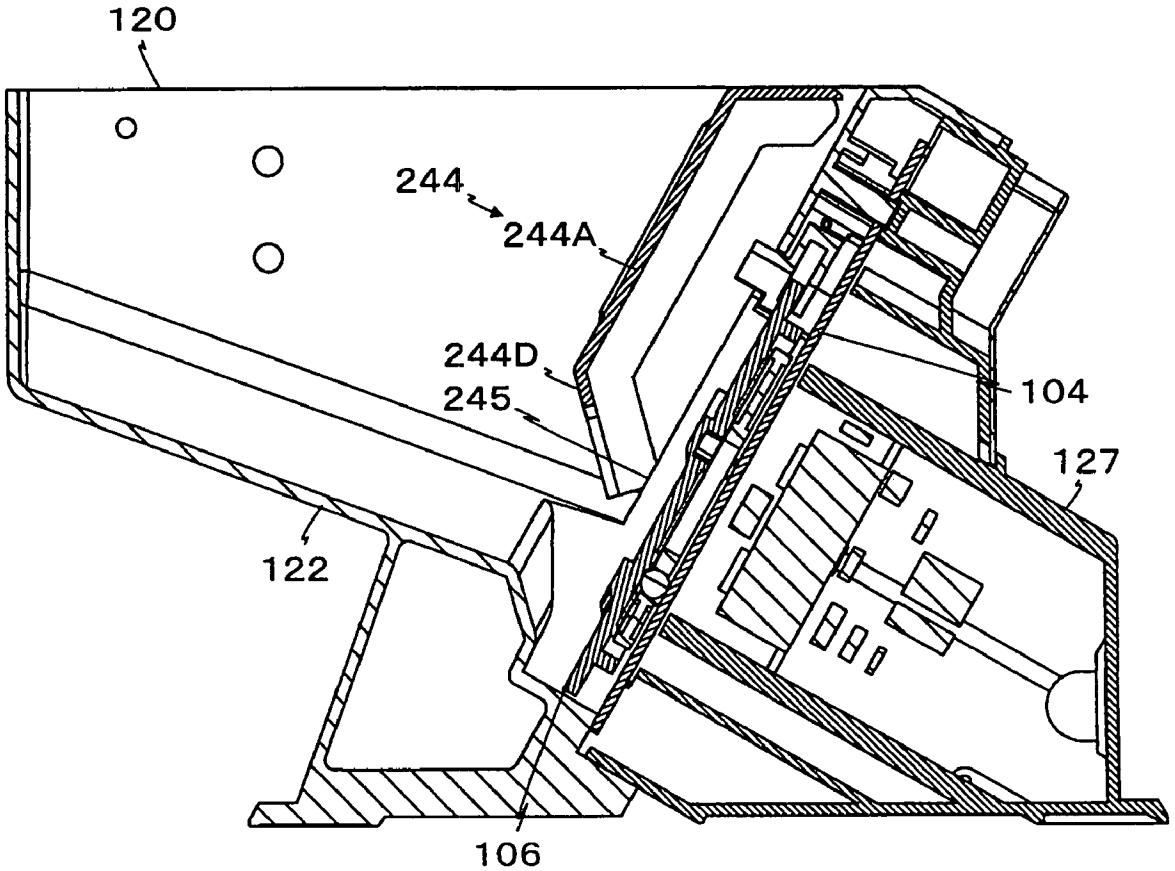
FIG. 7 is a cross-sectional view of the coin hopper along line D-D in FIG. 2.

The holding bowl 102 is first explained mainly with reference to FIGS. 1 and 5. The holding bowl 102 holds numerous coins in bulk and feeds the coins toward the rotating disk 106. The holding bowl 102 projects forward (left in FIG. 5) from the attachment base 104, and has a deeper depth toward the rotating disk 106. More specifically, the holding bowl 102 includes a head portion 102A, a coin inlet port 102B, and an outer covering unit 102C. The head portion 102A includes a bottom wall 122 provided obliquely downward toward the rotating disk 106. The coin inlet port 102B is provided to insert coins C. The outer covering unit 102C is provided adjacent to the attachment base 104 and covers at least a lower outer circumference of the rotating disk 106. The bottom wall 122 inclines such that coins C slide and drop toward the rotating disk 106 by own weight. The head portion 102A has a trough shape open to the rotating disk 106 side. The attachment base 104 is tightly and fixedly provided in the open end portion. A longitudinal groove 124 having a narrow width is provided at a lower front portion of the rotating disk 106 of the outer covering unit 102C, so that dropped coins C easily lean on the rotating risk 106.

The longitudinal groove 124 is formed by a longitudinal wall 125, the rotating disk 106, and the outer covering unit 102C. The longitudinal wall 125 is slightly inclined away from the rotating disk 106, relative to a line substantially parallel to the rotating disk 106, which is provided continuously from the outer covering case 102C. The width of the longitudinal groove 124, or a distance between an upper surface 126U of the rotating disk 106 and the longitudinal wall 125 of the holding bowl 102, is less than a diameter of the smallest coin C and five to 10 times a thickness of the thickest coin C. The width is also wider on a downstream side in a rotation direction of the rotating disk 106. The structure above is provided in order to stand coins C and further incline the coins C toward the rotating disk 106, and to stop coins C, including the last coin, at coin stoppers 128 (to be described hereinafter) for discharge. The outer covering unit 102C has a cylindrical shape and is provided proximate to the outer circumference of the rotating disk 106. Thereby, coins C having different diameters are held in bulk in the holding bowl 102, slide and drop by own weight on the inclined bottom wall 122, and move toward the rotating disk 106. Then, the coins C are agitated by the rotating disk 106 and guided to stay on the rotating disk 106 by the outer covering unit 102C. The bottom wall 122 and the longitudinal wall 125 are connected via an inclined wall 126, so that coins C easily drop while standing on the longitudinal groove 124.

Figure 10:
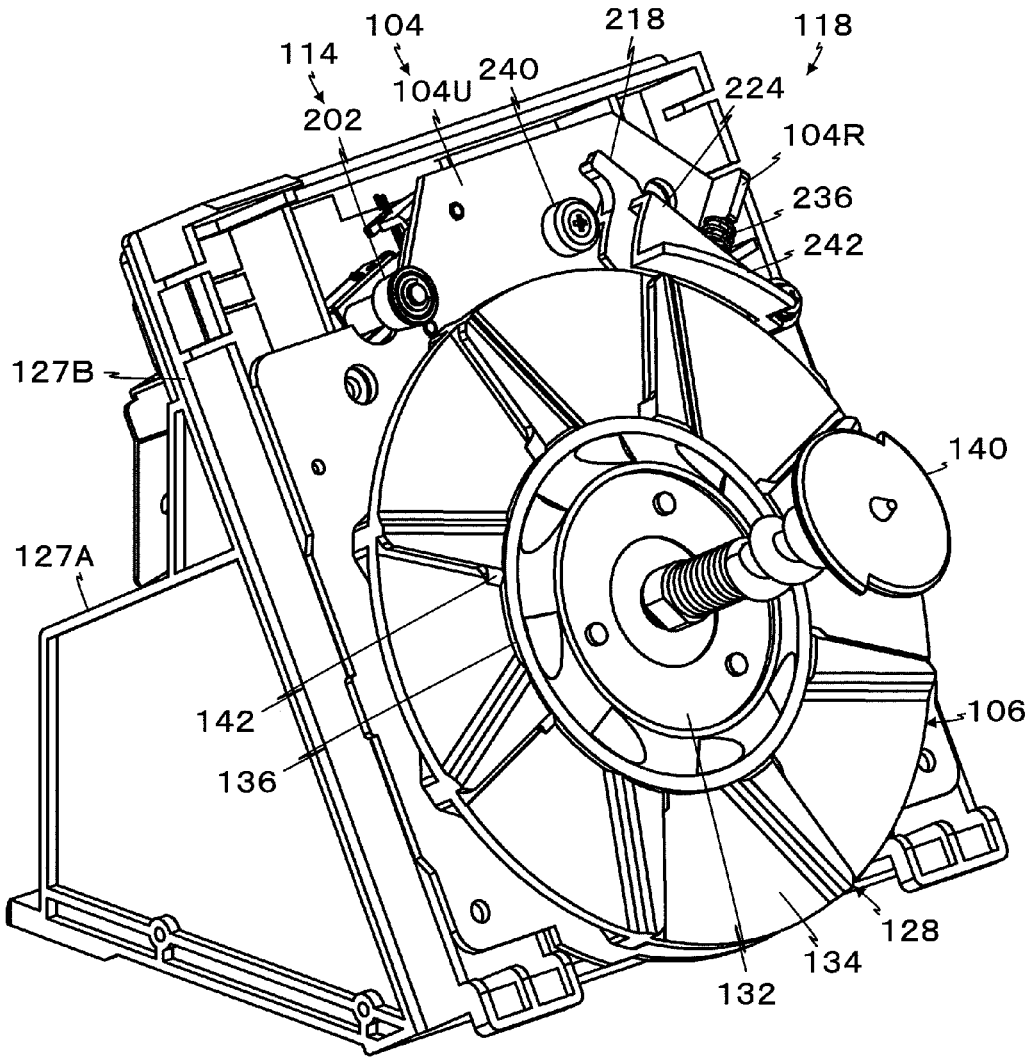
FIG. 10 is a perspective view of the rotating disk according to the first embodiment of the present invention, when a holding bowl is removed.

The attachment base 104 is explained next mainly with reference to FIG. 10. The attachment base 104 rotatably supports the rotating disk 106 and performs other functions. The attachment base 104 is mounted on an attachment head portion 127B of a box-shaped frame body 127. The frame body 127 includes an attachment foot portion 127A having a horizontal bottom surface, and the attachment head portion 127B provided obliquely at about 60 degrees relative to the attachment foot portion 127A. In other words, the attachment base 104 is provided obliquely at about 60 degrees to the horizontal line. The attachment foot portion 127A is installed in a game machine, for example, so that the coin hopper 100 is supported slidably in and out of the game machine. The rotating disk 106 is provided on an upper surface 104U side of the attachment base 104. The driver 108 is mounted on a rear surface side. It is preferable that the attachment head portion 127B have an inclination angle of a range between 50 degrees to 70 degrees. When the inclination angle is less than 50 degrees, a holding amount of coins C is small; whereas when the inclination angle is greater than 70 degrees, coins C tend to drop down from the coin stoppers 128 (described hereinafter).

The rotating disk 106 is explained next mainly with reference to FIGS. 4, 5, 8, and 10. The rotating disk 106 sorts, one by one, coins C having different diameters and held in bulk, and feeds the coins C to the receiver 112. The rotating disk 106 is a circular plate. A central projection 132 is provided in a central region. A ring-shaped holding surface 134 surrounds the central projection 132. The coin stoppers 128 are provided radially on the holding surface 134. It is preferable that a holding recess 135 having a circular ring shape be provided on the rear surface of the rotating disk 106 (see FIG. 12), and that a taper roller 137 be provided to the holding recess 135. Thereby, the load of coins C exerted to the rotating disk 106 is received on the upper surface 104U of the attachment base 104 through the taper roller 137. The structure is preferable in order to reduce rotational resistance of the rotating disk 106 for energy saving and durability improvement. The rotating disk 106 is provided on the upper surface 104U side of the attachment base 104 and obliquely upward parallel to the upper surface 104U. The rotating disk 106 is rotated counterclockwise in FIG. 4. It is preferable to provide a mushroom-shaped projection 140 in an upper central region of the central projection 132, so as to agitate coins C in the holding bowl 102.

An outer circumference of the central projection 132 constitutes a supporting rack 136, which is provided substantially perpendicular to the holding surface 134. A projection height of the supporting rack 136 from the holding surface 134 is lower than a thickness of a possibly thinnest coin. The supporting rack 136 holds one coin C alone between the coin stoppers 128 on the holding surface 134, in order to prevent two coins C from being supported on the supporting rack 136. The supporting rack 136 and the central projection 132 are connected via a conical portion 139. The conical portion 139 is provided with recessed portions 140 having a ship-bottom shape, so as to agitate coins C in the holding bowl 102.

The holding surface 134 contacts a lower surface of a coin C, whose periphery is supported by the supporting rack 136, and thereby holds the coin C. The holding surface 134 is a ring-shaped flat surface provided on the outer circumference of the central projection 132 and obliquely at about 60 degrees relative to the horizontal line.

Figure 9:
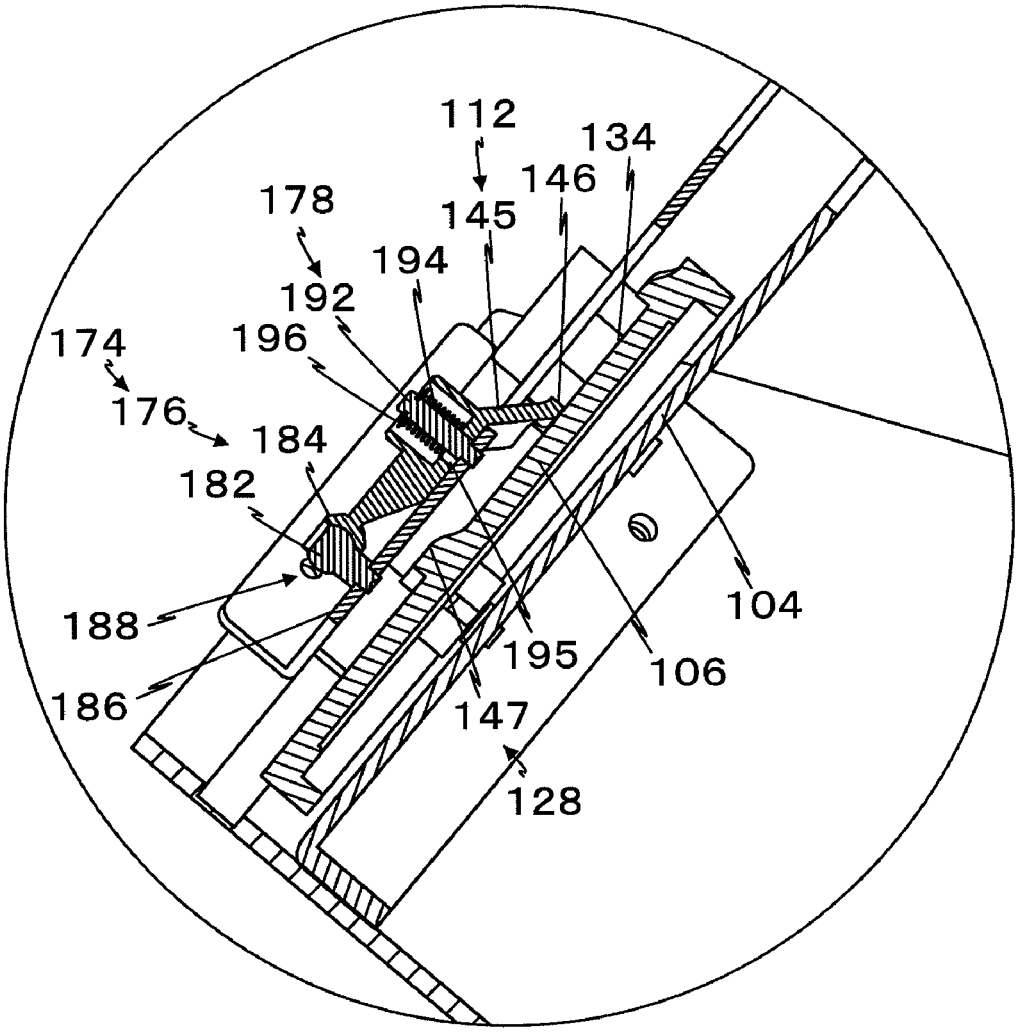
FIG. 9 is a cross-sectional view of the coin hopper along line F-F in FIG. 4.

The coin stoppers 128 contact a periphery of a coin C and pushes the coin C. The coin stoppers 128 are rib-shaped projections fixedly provided at an even interval in a radial direction relative to a rotating shaft line of the rotating disk 106. In the present embodiment, the coin stopper 128 has a trapezoidal shape tapering toward an end from a front view (see FIG. 4) and a trapezoidal shape from a cross-sectional view (see FIG. 9). A pressing edge 138 provided on a front end in the rotation direction pushes a coin C. The pressing edge 138 extends upward perpendicularly to the holding surface 134. The pressing edge 138 has a height from the holding surface 134 enough to push a coin C. When the height of the pressing edge 138 is low, however, a contact pressure per unit length to push a coin C increases. Thus, it is preferable that the pressing edge 138 have as high a height as possible. Conversely, when the height is higher than a predetermined amount, a length of a ride-on slope 142 (described hereinafter) for the receiver 112 is long. In this case, when a smallest diameter coin SC is pushed by the pressing edge 138, the smallest diameter coin SC is pushed onto the ride-on slope 142, thus easily dropping from a coin receiving body 145. Thus, is it preferable that the pressing edge 138 have as high a height as possible within a range where the smallest diameter coin SC is not pushed onto the ride-on slope 142 when being pushed by the pressing edge 138. According to experiments, it is preferable that the pressing edge 138 have a height of about 2 mm when handling coins having a diameter of 20 mm or larger.

Figure 8:
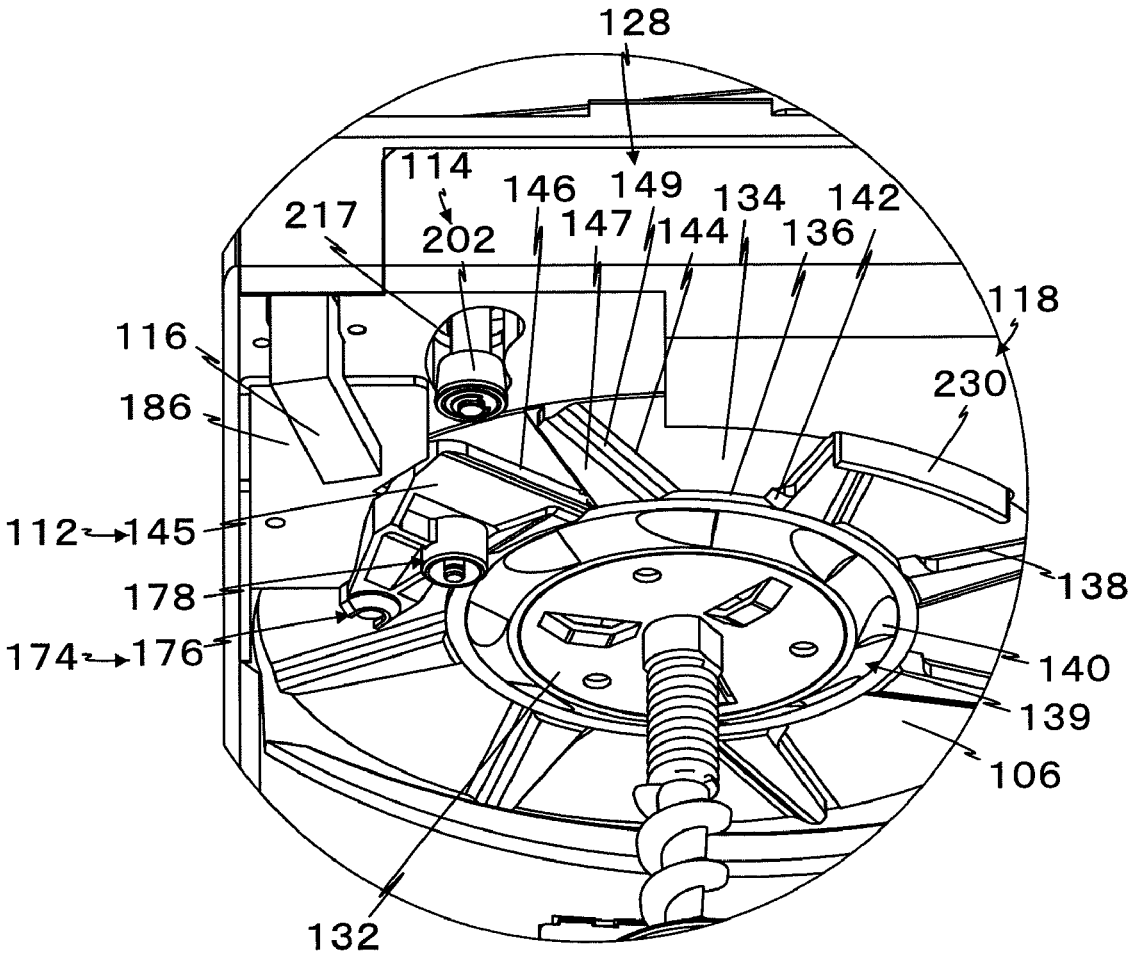
FIG. 8 is an enlarged perspective view of portion E of the coin hopper in FIG. 4.

It is preferable that a downstream edge 144 in the rotation direction of the coin stopper 128 be provided obliquely relative to the pressing edge 138, as shown in FIG. 8, such that an entire length of a receiving edge 146 of the coin receiving body 145 that constitutes the receiver 112 concurrently contacts the holding surface 134. The structure is preferable in order to prevent a coin C from being pinched between the holding surface 134 and the coin receiving body 145, when the receiving body 145 approaches the holding surface 134. An apex portion 147 and the downstream edge 144 of the coin stopper 128 are provided on a stepped slope 149. A coin C is held while one surface thereof contacts the holding surface 134 between adjacent coin stoppers 128. Thus, a distance between the pressing edge 138 and the downstream edge 144 is narrow on the supporting rack 136 side and gradually wider toward the periphery of the rotating disk 106. The holding surface 134 thus has an inverted trapezoidal shape relative to the central projection 132. When one possibly smallest diameter coin SC is supported by the supporting rack 136, another smallest diameter coin C is prevented from being supported by the supporting rack 136 (see FIG. 11A). In other words, two smallest diameter coins are prevented from coming into surface contact with the holding surface 134 in a location proximate to the supporting rack 136. The structure is provided so as to prevent a count error caused by sequential discharge of two coins.

The ride-on slope 142 pushes up an end portion 147 on the supporting rack 136 side of the receiving edge 146 of the coin receiving body 145 from the holding surface 134 along the slope. As shown in FIG. 8, the ride-on slope 142 is provided at a corner formed by the supporting rack 136 and the pressing edge 138. The ride-on slope 142 is a slope inclining from the holding surface 134 to the apex portion of the coin stopper 128. It is preferable that the ride-on slope 142 be provided within a triangle space formed when the supporting rack 136, the pressing edge 138, and the smallest diameter coin SC contact. When the ride-on slope 142 is too large, a part of a coin C is placed on the ride-on slope 142 when the coin C is being guided to the receiving edge 146, and thus the coin C easily drops from the receiving edge 146.

The driver 108 of the rotating disk 106 is explained next with reference to FIG. 5. The driver 108 rotates and drives the rotating disk 106 at a predetermined speed. The driver 108 in the present embodiment includes an electric motor 152 and a decelerator 154. The decelerator 154 is fixedly provided on the rear surface of the attachment base 104. An input gear of the decelerator 154 is engaged with an output gear (not shown in the drawing) of the electric motor 152, which is fixedly provided on the decelerator 154. An output shaft 158 of the decelerator 154 is passed through the attachment base 104, and tightly inserted and fixed to a fitting hole 162 in the central region of the rotating disk 106.

The receiver 112 of coins is explained next with reference to FIG. 8. The coin receiver 112 moves coins C, which are sorted and fed one by one by the rotating disk 106, in the circumferential direction of the rotating disk 106. The coin receiver 112 also escapes from the coin stoppers 128. In the present embodiment, the coin receiver 112 is a pentagonal planar body from a front view (see FIG. 4). The coin receiver 112 is provided as the coin receiving body 145, in which the linear receiving edge 146 is provided on a first end facing the pressing edge 138; a second end portion is movably supported by a movable supporter 174; and a middle portion is biased by a biasing unit 176 toward the rotating disk 106.

Figure 4:
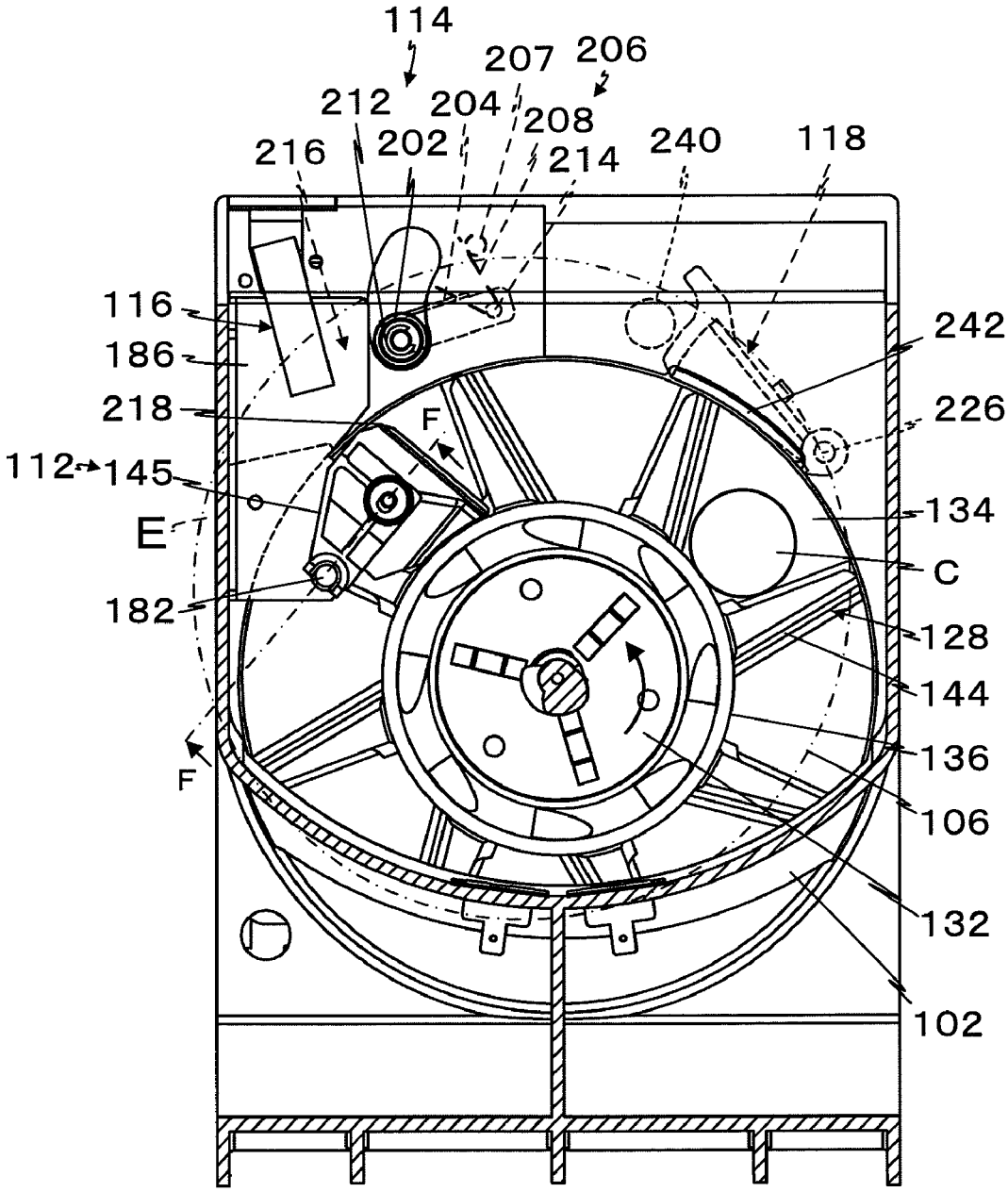
FIG. 4 is a cross-sectional view of the coin hopper according to the first embodiment of the present invention, similar to FIG. 3, when a regulating plate is removed.

The receiving edge 146 extends linearly from a vicinity of the supporting rack 136 in the circumferential direction of the rotating disk 106. When the receiving edge 146 is positioned opposite to the pressing edge 138 (when a coin C is located therebetween), extended lines of the edges form an acute angle (see FIG. 4). In order words, as shown in FIG. 4, the receiving edge 146 is offset upward relative to the center of the rotating disk 106 and faces substantially an entire length of the circumferential width of the holding surface 134.

The movable supporter 174 supports the coin receiver 112 so as to change the position of the coin receiver 112 in any directions, including up, down, left, and right, within a predetermined range. Specifically, the movable supporter 174 allows the coin receiving edge 146 to climb over the coin stopper 128 while contacting a location proximate to the holding surface 134 and the ride-on slope 142. In the present embodiment, the movable supporter 174 is provided as a spherical bearer 176 (see FIG. 9). The spherical bearer 176 includes a spherical shaft 182 and a spherical bearing 184. The spherical shaft 182 is provided integrally with the holding bowl 102 and fixedly on an upper surface of a cover plate 186, which is provided above the rotating disk 106 and in parallel with the rotating disk 106. The spherical bearing 184 is a hemisphere provided on an end portion opposite of the receiving edge 146 of the coin receiving body 145. The spherical bearing 184 receives and engages with the spherical shaft 182 from an open end portion 188, and contacts the surface. Thereby, in a case where a pressing force is exerted from the spherical bearing 184 to the spherical shaft 182 when the receiving edge 146 is pressed by coins C, the spherical shaft 182 receives the pressing force on the surface, thus minimizing the load per unit area and having an excellent durability. In addition, the spherical bearing 184 can easily be attached to and detached from the spherical shaft 182, since the hemispherical spherical bearing 184 can be fitted from the opening end portion 188. The biasing unit 178 biases the receiving edge 146 toward the holding surface 134. The biasing unit 178 includes a supporting shaft 192 and a spring 194.

The supporting shaft 192 projects upward from the cover plate 186 and penetrates a through hole 195 of the coin receiving body 145. The spring 194 is provided between a retainer 196 and the upper surface of the coin receiving body 145, the retainer being mounted at an upper end portion of the supporting shaft 192. The coin receiving body 145 is pressed toward the cover plate 186 by the spring 194. The coin receiving body 145 is normally prevented from moving rotatably by the upper surface of the cover plate 186, and the end of the receiving edge 146 is held in a standby position proximate to the holding surface 134. When one end of the receiving edge 146 rides on the ride-on slope 142 and the coin stopper 128, the coin receiving body 145 is inclined pivoting the spherical bearer 176. When substantially an entire length of the receiving edge 146 is positioned on the apex portion of the coin stopper 128, the coin receiving body 145 is inclined upward pivoting the spherical bearer 176. When the receiving edge 146 climbs over the coin stopper 128, the coin receiving body 145 is prevented from moving rotatably by the cover plate 186 and positioned in the standby position. The cover plate 186 is provided integrally with the holding bowl 102 and in parallel with the rotating disk 106.

The hopper 114 of coins C is explained next with reference to FIG. 4. The hopper 114 of coins C springs out coins C in a predetermined direction, the coins being guided by the receiving body 145 to outside of the rotating disk 106 area. The hopper 114 includes a hopping roller 202, a swing lever 204, and a spring 208. The swing lever 204 supports the hopping roller 202. The spring 208 serves as a biasing unit 206 that elastically biases the hopping roller 202 close to the receiver 112. The hopping roller 202 is mounted on an end portion of a shaft 212, which penetrates from the rear surface side to the front side of the attachment base 104. The shaft 212 is fixedly provided on the swing lever 204, which is rotatably mounted on a fixed shaft 214 projecting on the rear surface of the attachment base 104. The swing lever 204 is biased counterclockwise, as shown in FIG. 4, by the spring 208 which is engaged with a projection 207 at one end portion. The swing lever 204 is engaged with an elastic stopper 215 (see FIG. 5) so as to be held in a standby position. The hopping roller 202 is passed and projected through an elongated hole 217 provided in the attachment base 104 on an inlet port side of a coin route 216. The coin route 216 is provided between the upper surface of the attachment base 104 and the cover plate 186. Normally, the hopping roller 202 is held in a standby position, where a distance between the coin receiving body 145 and a peripheral end portion 218 of the rotating disk 106 is narrower than a diameter of the smallest diameter coin SC (a position shown in FIG. 4). Thereby, a coin C guided to the receiving edge 146 pushes up the hopping roller 202 when the coin C contacts the peripheral end portion 218. Immediately after a diameter portion passes therebetween, the coin C is sprung out by a force of the spring 208 applied by the hopping roller 202.

The detector 116 of coins C is explained next with reference to FIG. 4. The detector 116 detects coins C which are sprung out by the hopper 114. In the present embodiment, the detector 116 is provided on the coin route 216 downstream of the hopper 114. The detector 116 may be a photoelectric, magnetic, or another type detector. In the present embodiment, however, a transmissive-type photoelectric sensor is employed that includes a light projector and a light receiver, which are provided opposite to each other sandwiching the coin route 216. An end of the coin route 216 is a coin outlet port 222.

Figure 11:
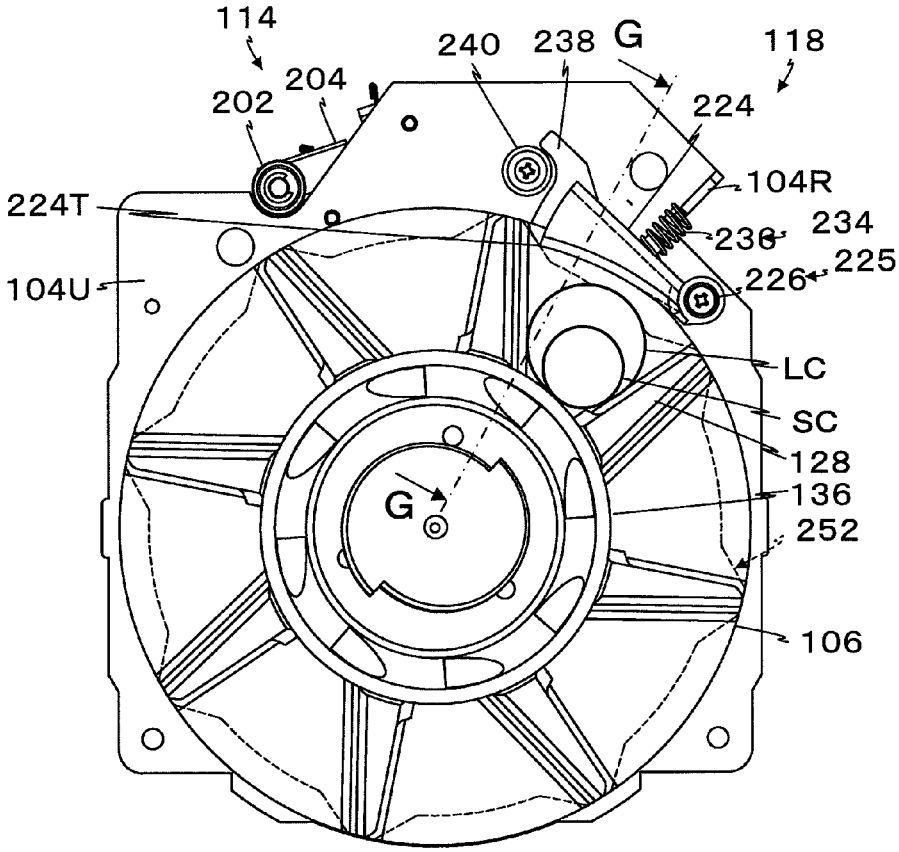
FIG. 11A is a front view of the rotating disk and a dropper according to the first embodiment of the present invention.
FIG. 11B is a cross-sectional view of the rotating disk and the dropper along line G-G in FIG. 11A.
Figure 11:
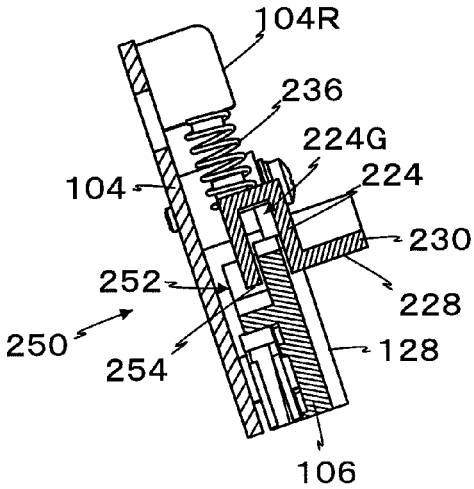

The dropper 118 of coins C according to the prevent invention is explained next with reference to FIGS. 4 and 10 through 12. The dropper 118 drops a coin C overlapping a coin C whose surface is in contact with the holding surface 134 and held thereby, so as to prevent overlapping coins C from reaching the receiver 112. The dropper 118 is provided above the rotating shaft line of the rotating disk 106 and opposite to the periphery of the rotating disk 106. As shown in FIG. 11A, the dropper 118 is provided substantially at a two o'clock position relative to the rotating disk 106. The dropper 118 is provided proximate to the holding surface 134 of the rotating disk 106 and slidably within a parallel plane surface. Specifically, a drop lever 224 having a cross-sectionally inverted channel shape is swingably pivoted on a second fixed shaft 226, which is a pivot shaft 255 fixedly provided on the attachment base 104. The drop lever 224 can thereby move reciprocally in a location proximate to the holding surface 134 of the rotating disk 106. The drop lever 224 receives a counterclockwise rotating force from a spring 236, which serves as a biasing unit 234 provided between the drop lever 224 and a spring base 104R projecting from the attachment base 104. An integrally-provided projection 238 is engaged with a stopper 240 fixedly provided on the attachment base 104, and thereby the drop lever 224 is held in a standby position SP. It is preferable that the stopper 240 be provided with an elastic material around an outer circumference thereof, so as to prevent a bounce and slapping sound caused when the projection 238 contacts.

As shown in FIG. 11A, the drop lever 224 is provided in the standby position SP, such that an end 224T is provided most proximate to the supporting rack 136. The position is closer to the supporting rack 136 than a diameter of a possibly largest coin LC. In other words, the periphery of the largest coin LC supported by the supporting rack 136 contacts the drop lever 224, whereas the periphery of the smallest coin SC supported by the supporting rack 136 does not contact the drop lever 224. When a contact edge 228 of the drop lever 224 provided on the supporting rack 136 side is contacted externally with the rotating disk 106, the contact edge 228 has a crescent shape centering on the shaft center of the rotating disk 106, and has at least a thickness exceeding the thickness of the thickest coin C whose surface contacts the holding surface 134. When many coins C are held, however, coins C may reach the drop lever 224 while bunching up together. Thus, it is preferable to provide a visor-shaped drop plate 230 extending for a predetermined amount, such as, for example, about 20 times the coin thickness, in parallel with the rotating shaft line of the rotating disk 106, as provided in the embodiment. When overlapping coins C reach the drop lever 224, the drop lever 224 contacts the periphery of a coin C whose surface contacts the holding surface 134 and of a coin C that overlaps the contacting coin C. Then, the overlapping coin C is relatively moved obliquely downward by the drop lever 224, and drops down. However, the coin C, whose surface contacts the holding surface 134 and whose periphery is supported by the supporting rack 136, does not drop since the coin C is supported by the supporting rack 136. Thereby, one coin C alone is in surface contact with and held by the holding surface 134 between the coin stoppers 128. When the smallest diameter coin SC reaches the drop lever 224 as the coin does not contact the supporting rack 136 due to centrifugal force, the coin is moved relatively toward the supporting rack 136 by the drop lever 224. Then, the coin C whose surface contacts the holding surface 134 is supported by the supporting rack 136, but the overlapping coin C is not supported by the supporting rack 136. Thus, the overlapping coin C is guided by the central projection 132 so as to drop into the holding bowl 102. A recessed groove 224G of the drop lever 224 covers the periphery of the rotating disk 106.

Figure 12:
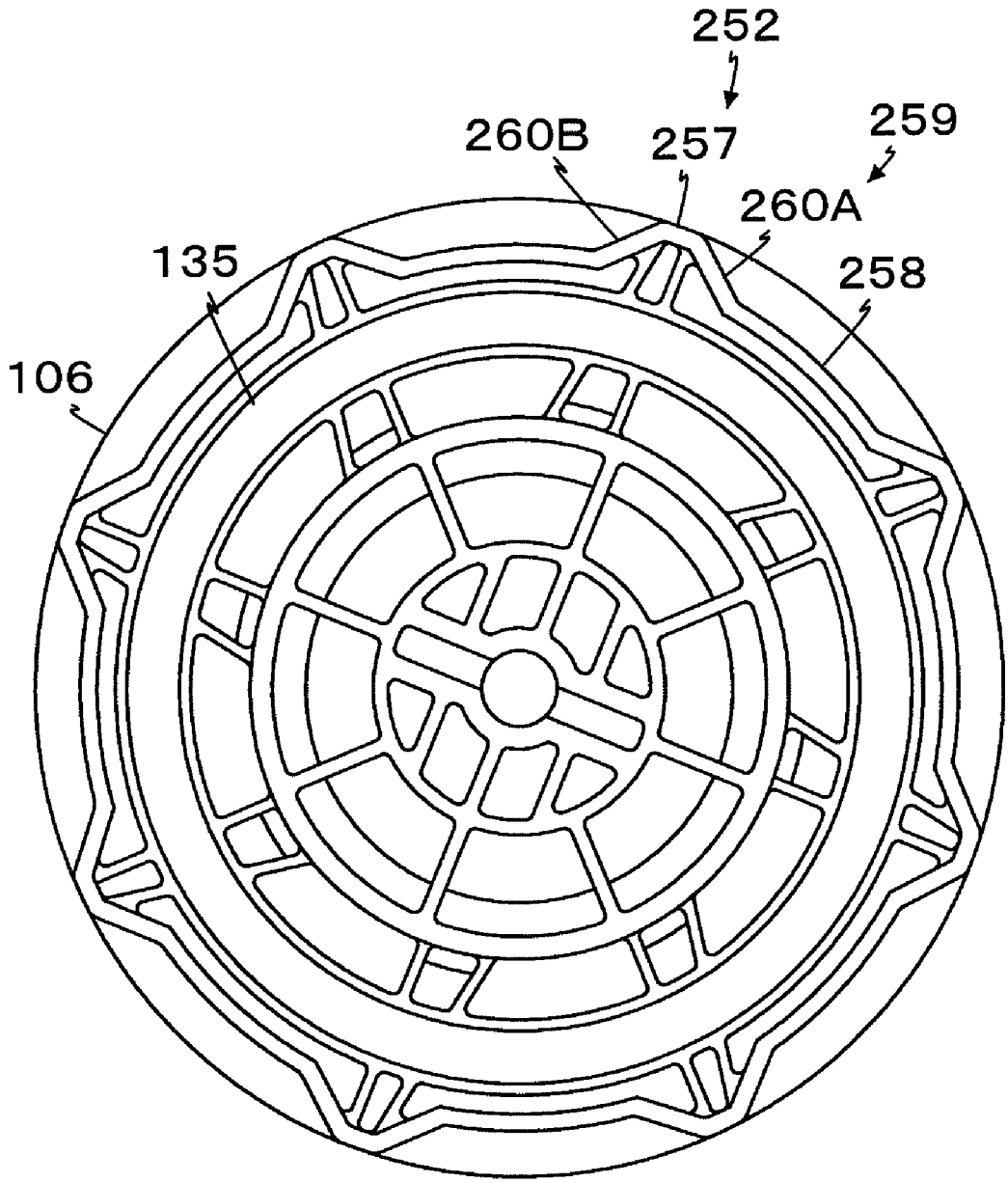
FIG. 12 is a rear view of the rotating disk according to the first embodiment of the present invention.
Figure 13:
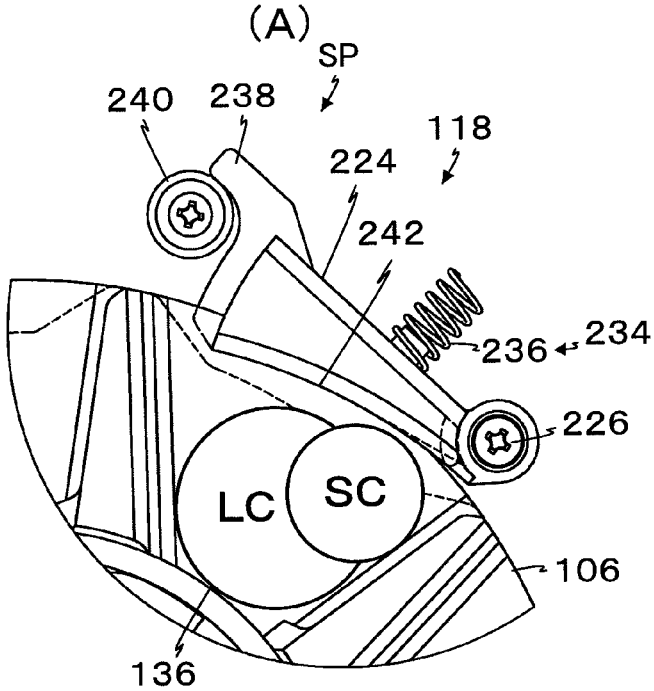
FIGS. 13A and 13B illustrate functions of the dropper according to the first embodiment of the present invention.
Figure 13:
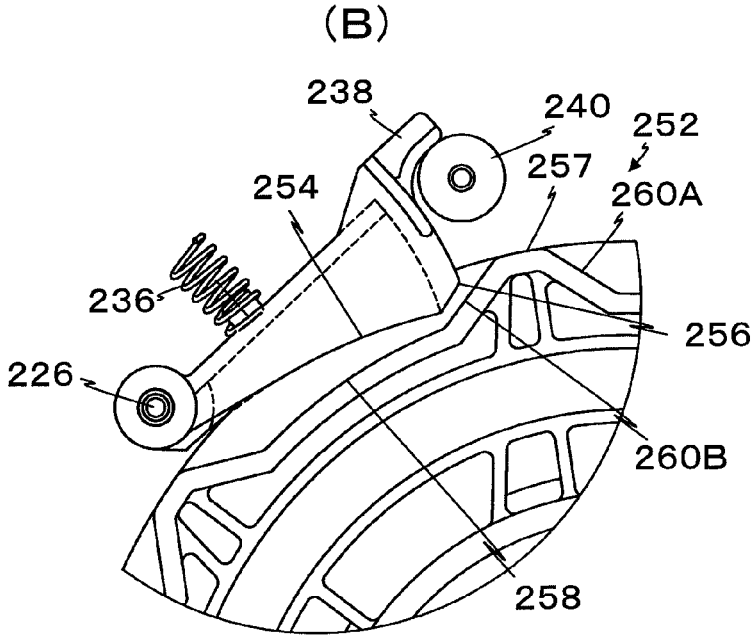
Figure 14:
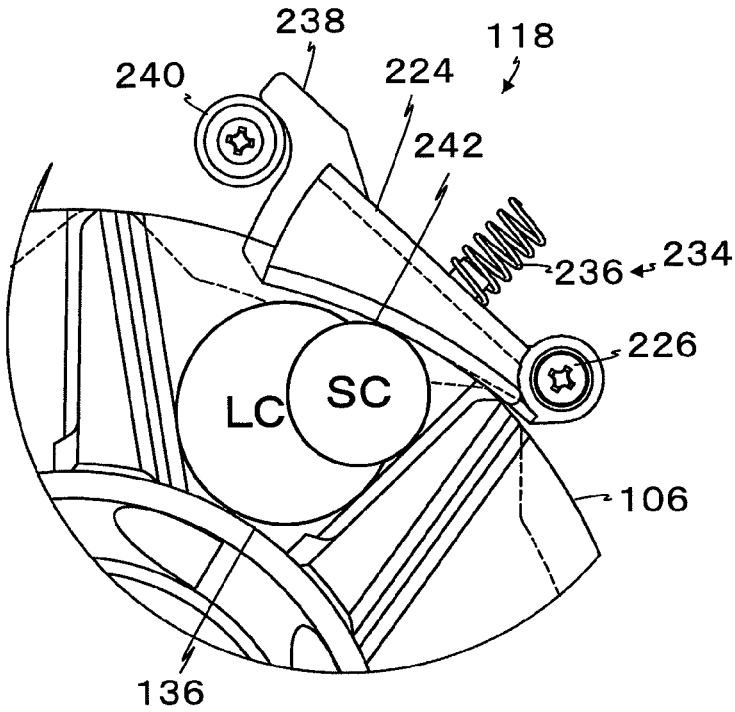
FIGS. 14A and 14B illustrate functions of the dropper according to the first embodiment of the present invention.
Figure 14:
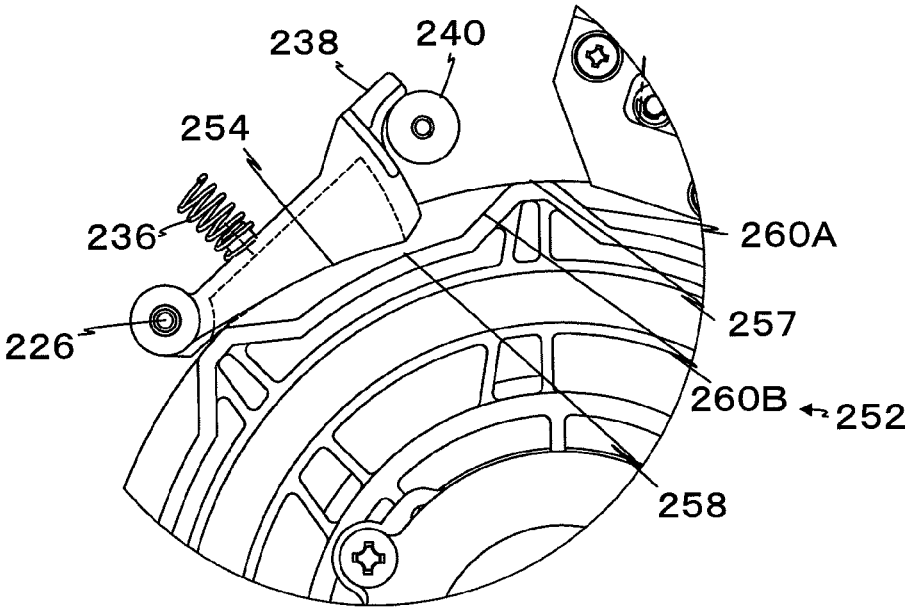
Figure 15:
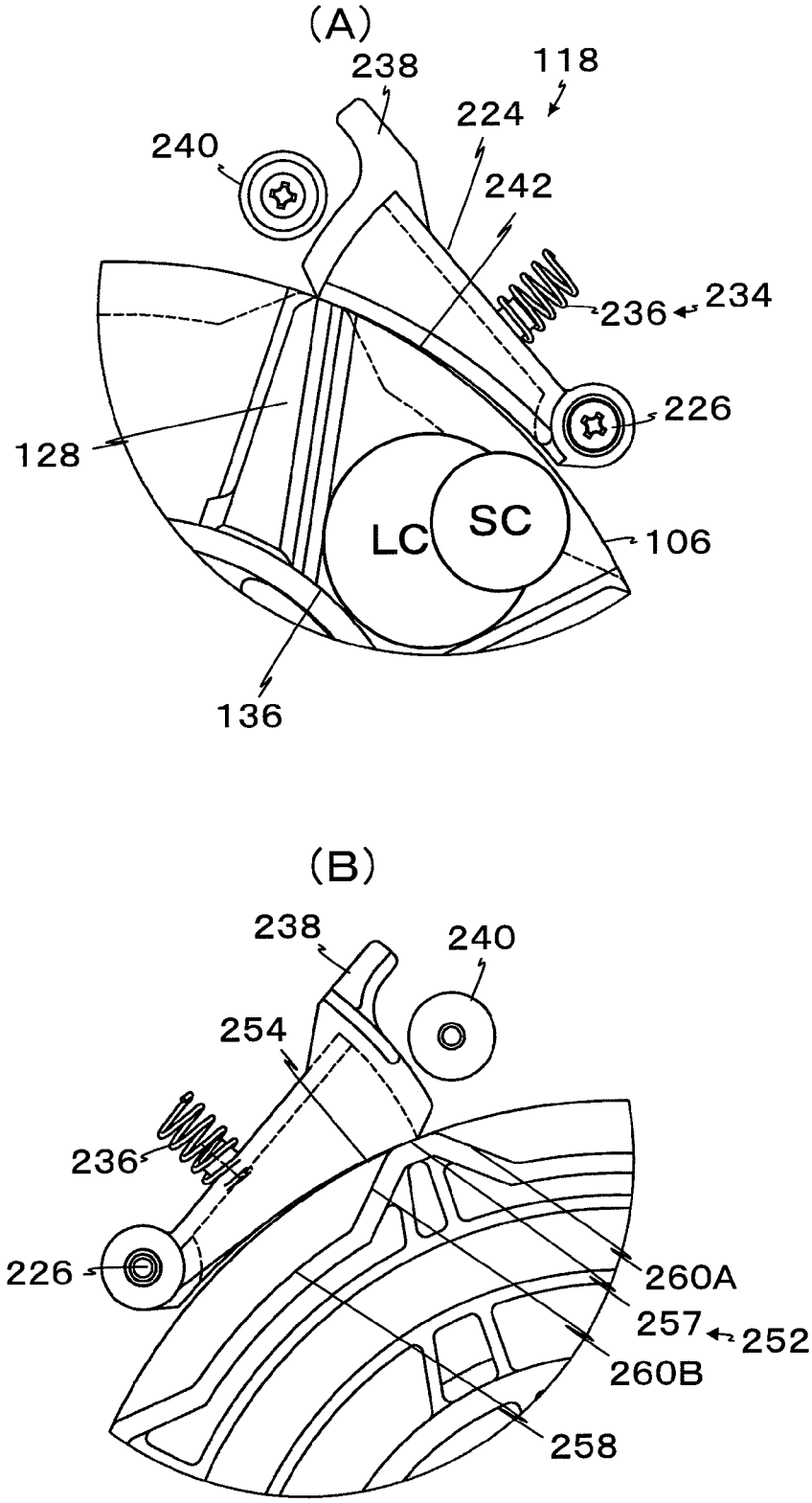
FIGS. 15A and 15B illustrate functions of the dropper according to the first embodiment of the present invention.
Figure 16:
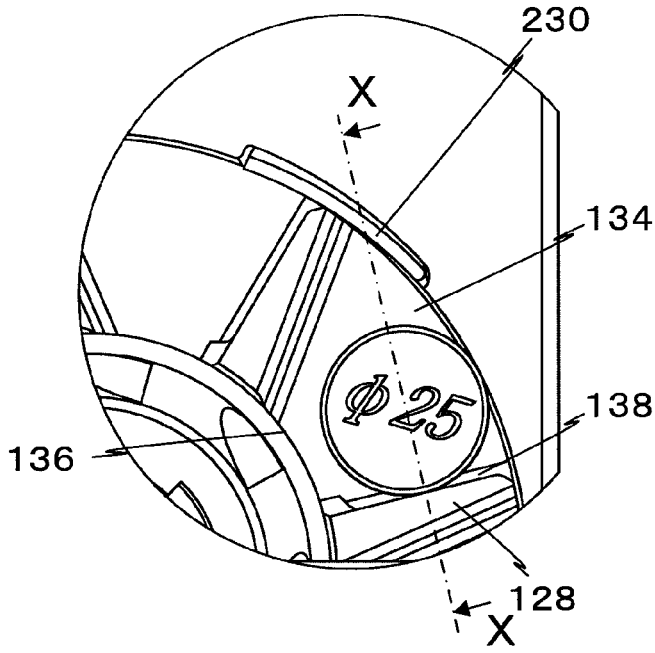
FIGS. 16A and 16B illustrate operations of the dropper according to the first embodiment of the present invention.
Figure 16:
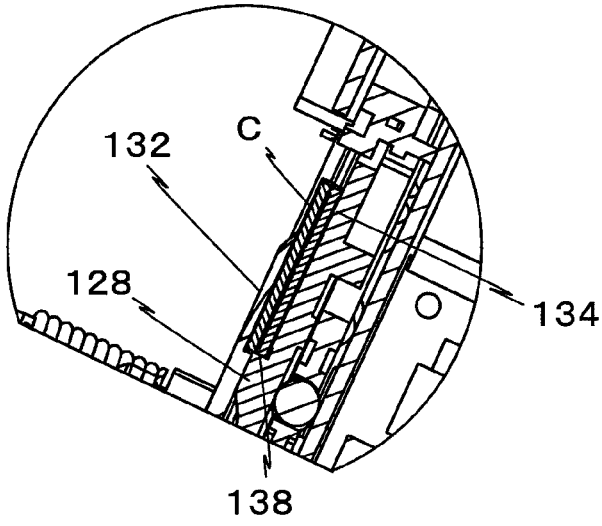
Figure 17:
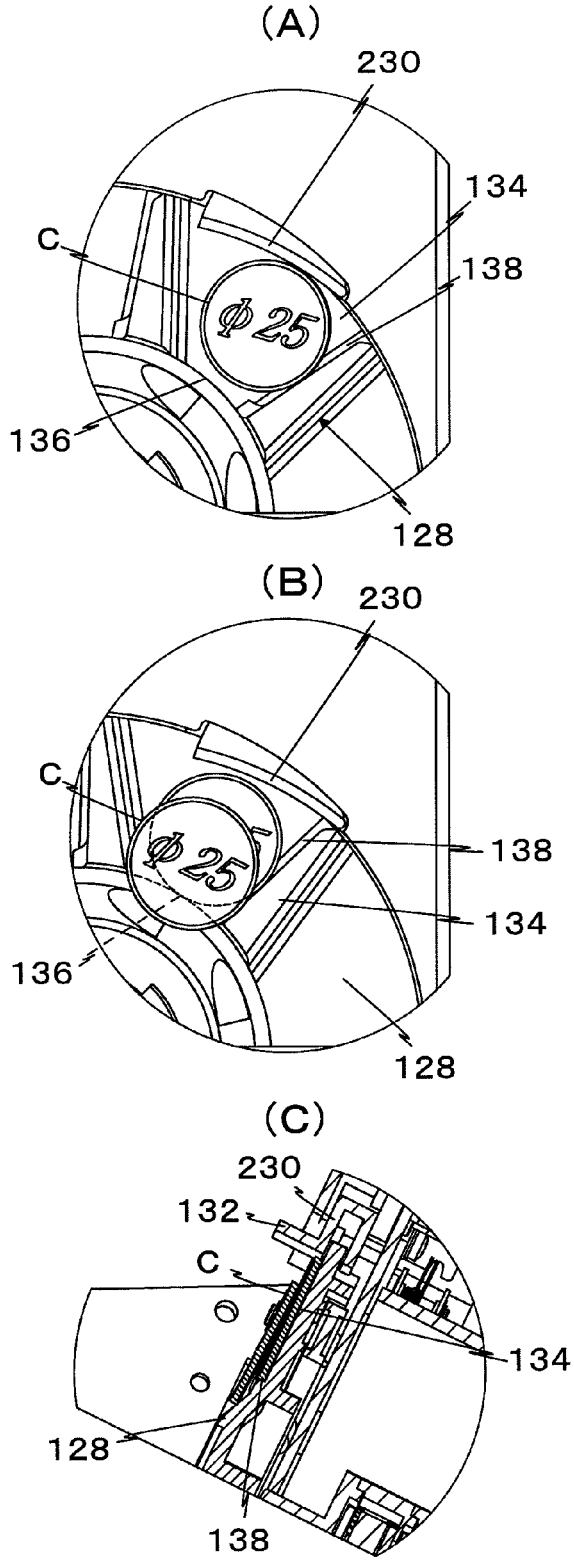
FIGS. 17A to 17C illustrate operations of the dropper according to the first embodiment of the present invention.

A retractor 250 for the dropper 118 is explained next with reference to FIGS. 11A to 12. The retractor 250 prevents the dropper 118 from hitting the coin stoppers 128. The retractor 250 includes a cam 252, which is provided on the rear surface of the rotating disk 106, and a cam follower 254, which is integrally provided with the drop lever 224. The cam follower 254 is a lower end portion of the channel-shaped drop lever 224 provided on the rear surface side of the rotating disk 106. The cam follower 254 has a same shape as the contact edge 228. A reverse cam follower 256 in a reverse direction continues from the cam follower 254. The reserve cam follower 256 has a same crescent shape as the contact edge 228 and is provided opposite to the cam 252.

The cam 252 is explained below. As shown in FIGS. 11A to 12, the cam 252 is a circumferential cam that includes an escape portion 257, a standby portion 258, and inclined portions 260A and 260B. The escape portion 257 provided opposite to the coin stopper 128 corresponds to the diameter of the rotating disk 128. The standby portion 258 is provided between adjacent escape portions 257. The inclined portions 260A and 260B serve as a ride-on portion 259 that connects the escape portion 257 and the standby portion 258. When the drop lever 224 is positioned in the standby position SP, the cam follower 254 faces the standby portion 258 and does not contact the standby portion 258. Rotation of the rotating disk 128 concurrently rotates the cam 252, which, through the cam follower 254, swings the drop lever 224 in connection with the location of the coin stopper 128. Specifically, when the coin stopper 128 approaches, the inclined portion 260A comes into contact with the cam follower 254, which is then moved rotatably in the circumferential direction of the rotating disk 106. The cam follower 254 is further contacted with the escape portion 257. Concurrently, the drop lever 224 is moved rotatably and shifted in the circumferential direction of the rotating disk 106. Thereby, the drop lever 224 is prevented from hitting the coin stopper 128, and thus the durability of the coin stopper 128 is improved. When the escape portion 257 passes through, the reverse cam follower 256 is contacted with the inclined portion 260B. Then, the drop lever 224 is moved rotatably by the spring 236 toward the center of the rotating disk 106, engaged with the stopper 240 during the rotation, and held in the standby position SP. When the rotating disk 106 is rotated reversely, the reverse cam follower 256 is conversely pushed up by the inclined surface 260B and then contacted with the escape portion 257. Thus, the drop lever 224 does not contact the coin stoppers 128.

The regulator 120 of coins C is explained next with reference to FIGS. 3 and 5 to 7. The regulator 120 regulates an amount of coins C that flow down from the holding bowl 102 toward the rotating disk 106. The regulator 120 is provided as a regulating plate 244, which is swingably mounted by inserting an attachment shaft (not shown in the drawings) into a circular hole in a location immediately front of the rotating disk 106, the attachment shaft being provided on a side surface of an upper end portion, the circular hole being provided in an upper end portion of a side wall of the holding bowl 102. A lower surface of a side end portion of the regulating plate 244 is normally engaged with a stopper 245 projecting from an inner surface of the holding bowl 102. The regulating plate 244 stands still in a standby position described below. An upper portion 244A, which is about two-thirds upper portion of the control panel 244, is provided in parallel relative to the rotating disk 106. A lower end portion is divided into an upstream portion 244U, which faces upstream in the rotation direction of the rotation disk 106, and a downstream portion 244D. A lower end portion of the upstream portion 244U includes an inclined guide surface 262, which is provided obliquely toward the rotating disk 106. A distance between a lower end portion of the downstream portion 244D and the holding surface 134 is about the same as the diameter of the smallest diameter coin. Thereby, the regulating plate 244 substantially regulates the amount of coins C flowing downward to the oppositely provided rotating disk 106, thus ensuring the coin stoppers 128 to stop the coins C. The lower end portion of the downstream portion 244D is bent relative to the upper portion 244A and provided obliquely at about 70 degrees relative to the horizontal line. Thereby, a relatively large amount of coins C flow down to a downstream location in the rotation direction of the rotating disk 106, and thus coins C are easily stopped by the coin stoppers 128. Consequently, a regulated amount of coins C are provided between the regulating plate 244 and the rotating disk 106, and thus the amount of coins C is regulated so as to be easily stopped by the coin stoppers 128.

Operations of the coin hopper 100 according to the present embodiment are explained below with further reference to FIGS. 13A to 17C. Coins C having a diameter between 20 mm and 30 mm are mixed and held in bulk in the holding bowl 102. Counterclockwise rotation of the rotating disk 106, as shown in FIG. 4, agitates coins C in a front portion of the rotating disk 106. The coins C are then stopped by the coin stoppers 128. The lower surface of the coins C stopped by the coin stoppers 128 contacts the holding surface 134. When coins C are located below the center of the rotating disk 106, the coins C tend to move toward the periphery of the rotating disk 106 due to gravity. The coins C are then directed by the circumference of the outer covering unit 102C so as to move clockwise, as shown in FIG. 4. When coins C are located above the rotating shaft line of the rotating disk 106, the coins C roll toward the supporting rack 136 due to gravity. The coins C, whose lower periphery is held by the supporting rack 136, are pushed by the pressing edge 138 so as to move counterclockwise. When coins C overlap, an upper coin C is not supported by the supporting rack 136 having a height lower than the thickness of the thinnest coin, and then drops into the holding bowl 102. Thus, one coin C alone is in surface contact with and held by the holding surface 134 between the coin stoppers 128 (see FIGS. 13A and 13B).

When the rotating disk 106 is further rotated, the coins C reach the dropper 118. The contact edge 228 of the drop lever 224 contacts the outer periphery of the largest diameter coin LC that contacts the supporting rack 136 and the pressing edge 138, and thus the coin C is pressed against the supporting rack 136 (see FIGS. 14A and 14B). Thereby, the coin C whose surface contacts the holding surface 134 is supported by the supporting rack 136, whereas the coin C placed on the contacting coin is by no means supported, and thus drops into the holding bowl 102 (see FIG. 17B).

When a small diameter coin SC is not supported by the supporting rack 136 due to centrifugal force and thus reaches the drop lever 224 (see FIGS. 14A and 14B), a coin C whose surface contacts the holding surface 134 and a coin C placed on the contacting coin are pressed by the pressing edge 228 of the drop lever 224, and moved toward the supporting rack 136. While the lower coin C is supported by the supporting rack 136, the upper coin C is not supported, which thus drops into the holding bowl 102 as described above. Thereby, one coin C alone is fed to the coin receiving body 112.

Then, the cam 252 is rotated concurrently with the rotation of the rotating disk 106 (see FIG. 13B). When the coin stopper 128 approaches the drop lever 224 thereby, the drop lever 224 is pushed up by the inclined surface 260A of the cam follower 252, and thus moved rotatably in the circumferential direction of the rotating disk 106 (see FIG. 14B). Then, the escape portion 257 of the cam 252 comes into contact with the cam follower 254, which is thus pushed slightly outside of the circumference of the rotating disk 106 (see FIG. 15B). Subsequently, the inclined surface 260B of the cam 252 faces the cam follower 254. The drop lever 224 is then pressed against the inclined surface 260B by the spring force of the spring 236, and thus the drop lever 224 is concurrently moved and rotated in the same direction. The projection 238 is engaged with the stopper 240 during the rotation, and thus the drop lever 224 is held in the standby position SP (see FIG. 13A).

Figure 18:
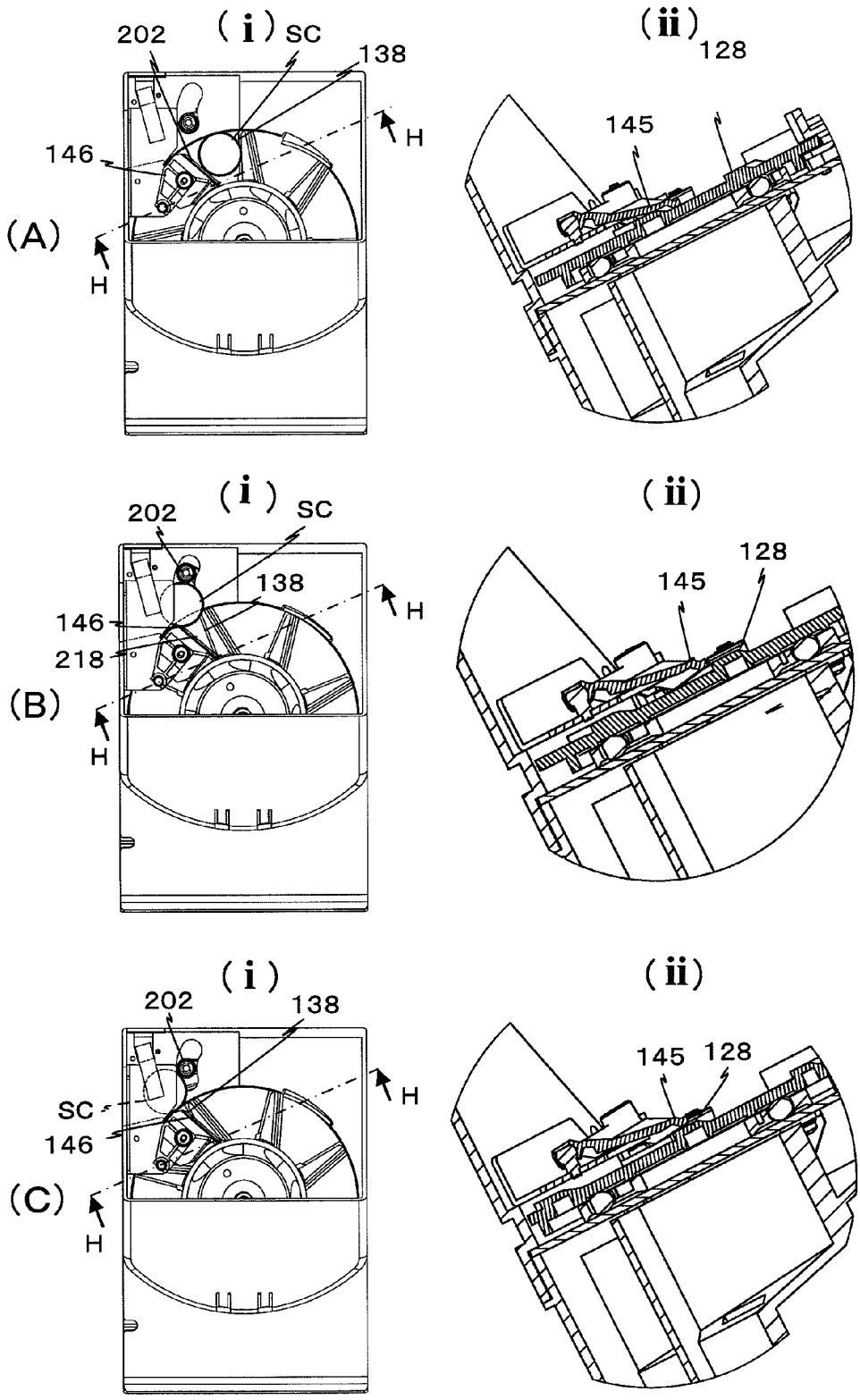
FIGS. 18Ai to 18Cii illustrate operations of a receiver according to the first embodiment of the present invention.
Figure 19:
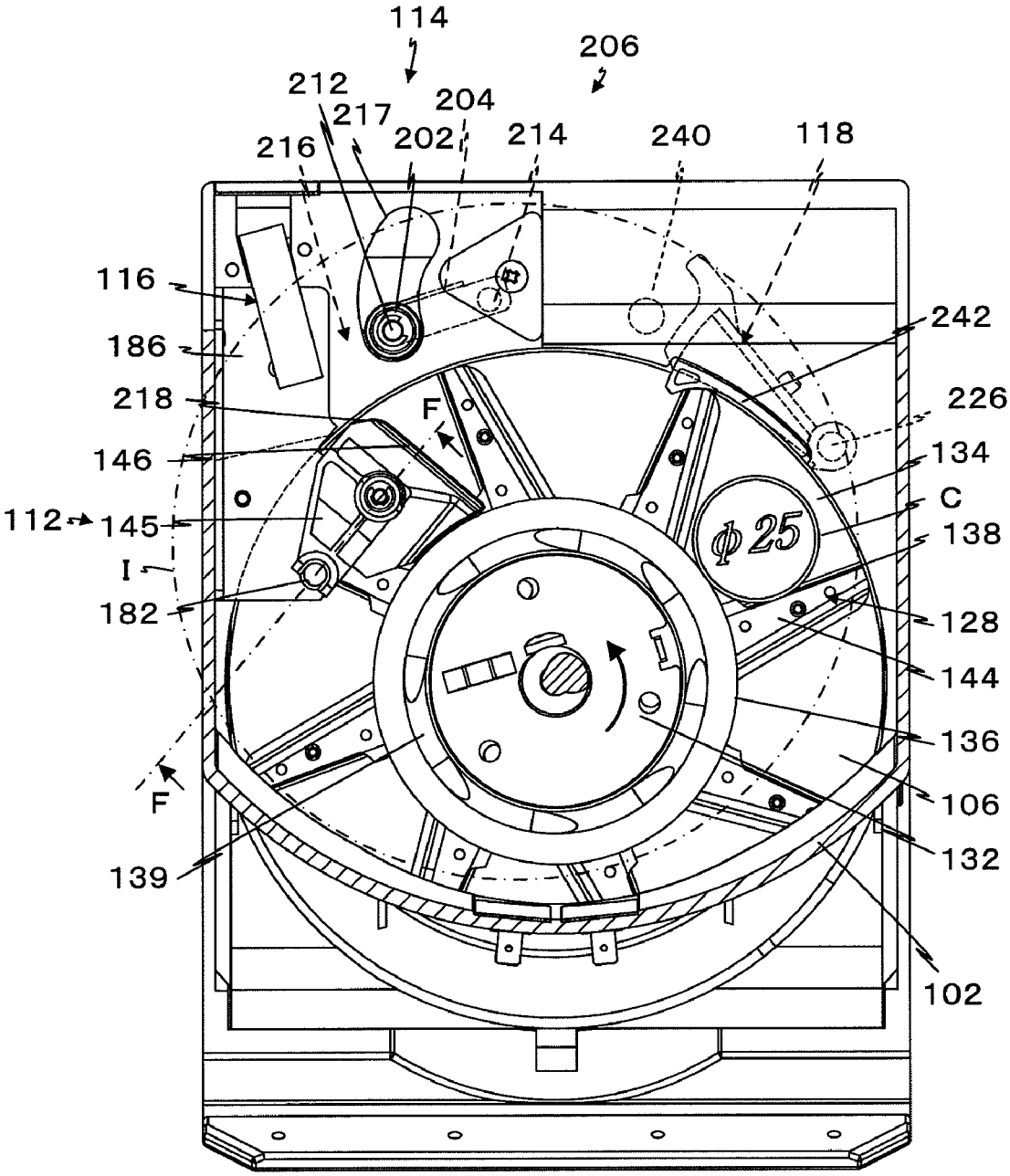
FIG. 19 is a cross-sectional view of a coin hopper according to a second embodiment of the present invention, similar to FIG. 3, when a regulating plate is removed.
Figure 20:
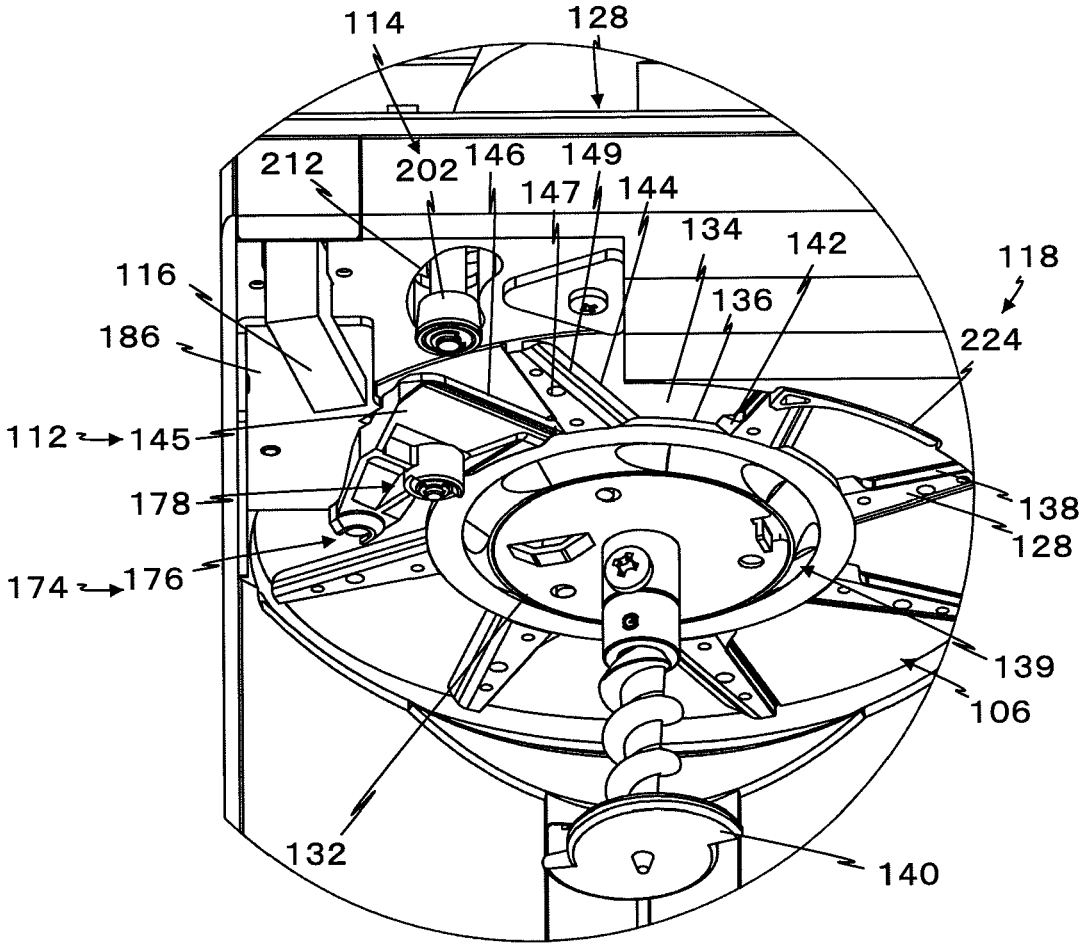
FIG. 20 is an enlarged perspective view of portion H of the coin hopper in FIG. 19.
Figure 21:
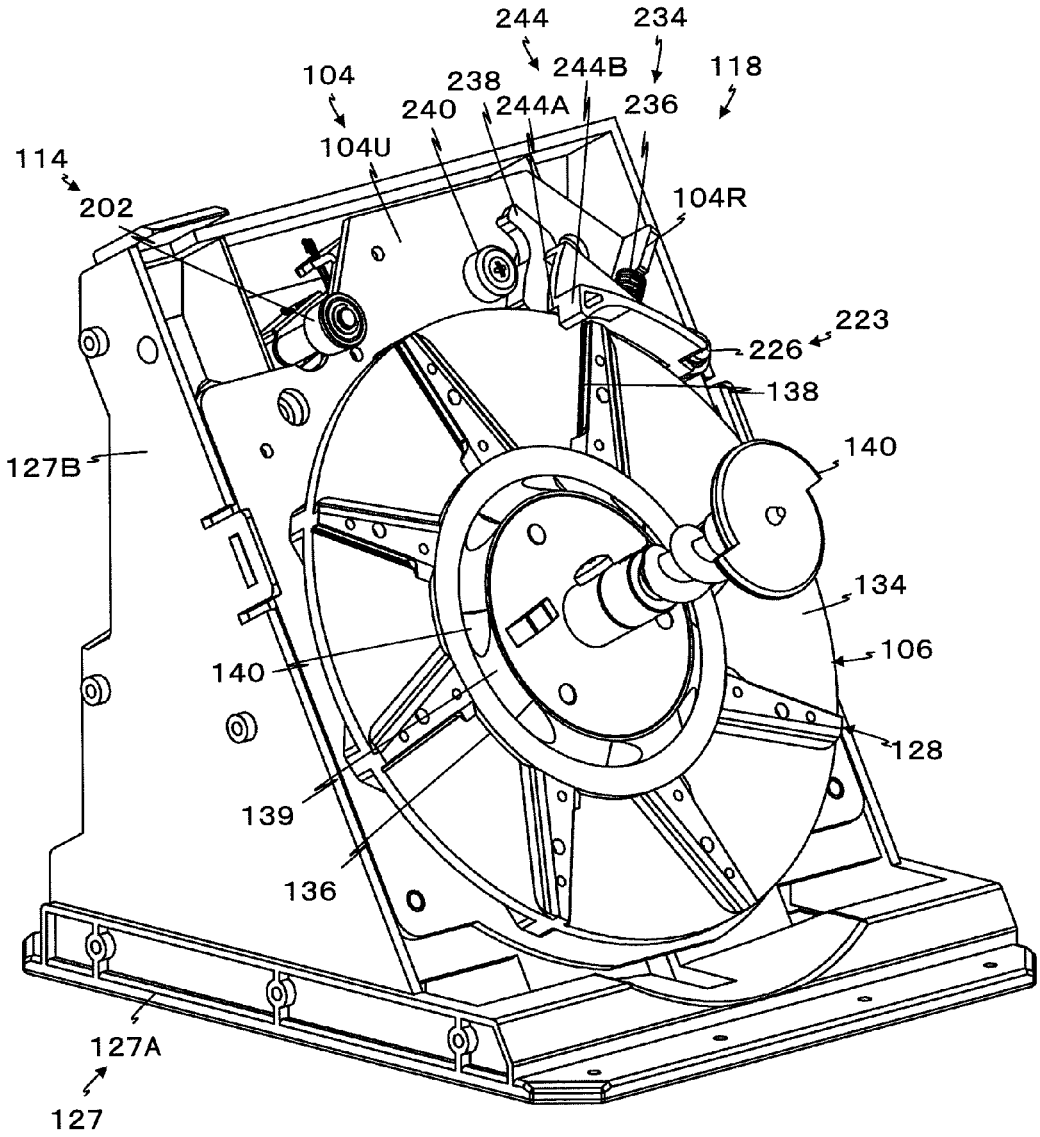
FIG. 21 is a perspective view of a rotating disk and other components according to the second embodiment of the present invention, when a holding bowl is removed.

When a front end of a coin C pushed by the coin stopper 128 comes into contact with the receiving edge 146 of the coin receiving body 145, an acute angle is formed between extended lines of the pressing edge 138 and the receiving edge 146, even in a case where a smallest diameter coin SC is held (see FIG. 18Ai). Thus, the smallest diameter coin SC is pushed by the pressing edge 138, and moved along the receiving edge 146 and then toward the periphery of the rotating disk 106. When the smallest diameter coin SC approaches the end portion 218, an upper end of the smallest diameter coin SC contacts and pushes up the hopping roller 202 (see FIG. 18Bi). When the smallest diameter coin SC contacts the apex portion of the end portion 218, the hopping roller 202 is positioned immediately before facing a diameter portion of the smallest diameter coin SC, and thus the smallest diameter coin C has yet to be sprung out. At this time, the end portion of the coin receiver 112 on the supporting rack 136 side slightly rides on the ride-on slope 142, and the receiving edge 146 starts to incline slightly relative to the holding surface 134 (see FIG. 18Bii). Since the peripheral end portion 218 is positioned away from the end portion, however, the peripheral end portion 218 substantially remains at the same location.

When the rotating disk 106 is further rotated, the diameter portion of the smallest diameter coin SC passes between the end portion 218 and the hopping roller 202. Then, the hopping roller 202 springs out the coin SC to the coin route 216, by using the spring force of the spring 208 (see FIG. 18Ci). The sprung out coin SC is discharged to a predetermined location from the outlet port 222. When the receiving edge 146 rides on the ride-on slope 142 (see FIG. 18Cii), the receiving edge 146 faces the apex portion of the coin stopper 128 and comes into contact at an acute angle (see FIG. 18Ci). The further rotation of the rotating disk 106 thus allows the receiving edge 146 to climb over the apex portion 147 of the coin stopper 128. After passing the apex portion 147 of the coin stopper 128, the receiving edge 146 comes into contact with the downward slope 149. The receiving edge 146 approaches the holding surface 134 along the downward slope 149, and then the entire length of the receiving edge 146 concurrently comes close to the holding surface 134 in the downstream edge 144. Thus, even when coins C lean against the downward slope 149, the receiving edge 146, which is positioned lower than the coins C, pushes up and drops the coins C into the holding bowl 102. Thereby, the coins C are not pinched between the coin receiver 112 and the rotating disk 106. Coins C that pass through the coin route 218 are detected by the detector 116, which outputs a detection signal. The detection signal is used for counting discharged coins C and for other purposes. The operations described above apply to a case of large diameter coins.

When it is detected that the rotating disk 106 is not rotated for a predetermined time period, the rotating disk 106 is reversed. When the rotating disk 106 is reversed, the drop lever 224 is pushed up before contacting the coin stopper 128 as the reverse cam follower 256 contacts the inclined surface 260B, and then contacts the escape portion 257. Thereby, the drop lever 224 is moved concurrently, thus allowing the rotating disk 106 to rotate reversely while preventing contact with the coin stopper 128.

Second Embodiment

Components identical to those in the First Embodiment are provided with identical numeral references. Structures different from those in the First Embodiment are explained below.

It is preferable that a pressing edge 138 of a coin stopper 128 have a height from a holding surface 134 lower than a thickness of a thinnest coin C. Thereby, even when the thinnest coin C is used, only a coin C whose surface contacts the holding surface 134 is pushed by the pressing edge 138 (coin stopper 128). The structure is preferable in order to prevent two thinnest coins from being pushed by the pressing edge 138 when the coins overlap. However, the pressing edge 138 may have a height higher than the thickness of the thinnest coin. Since a supporting rack 136 is lower than the thickness of the thinnest coin, a coin C overlapping a coin C whose surface contacts the holding surface 134 is not supported by the supporting rack 136 and thus drops into a holding bowl 102. The pressing edge 138, which comes into contact with metal coins C, needs to be durable. It is thus preferable that a five-fingered metal plate be insert-formed in a rotating disk 106 when the rotating disk 106 is plastic-molded, such that the metal portion is exposed to the pressing edge 138.

Figure 22:
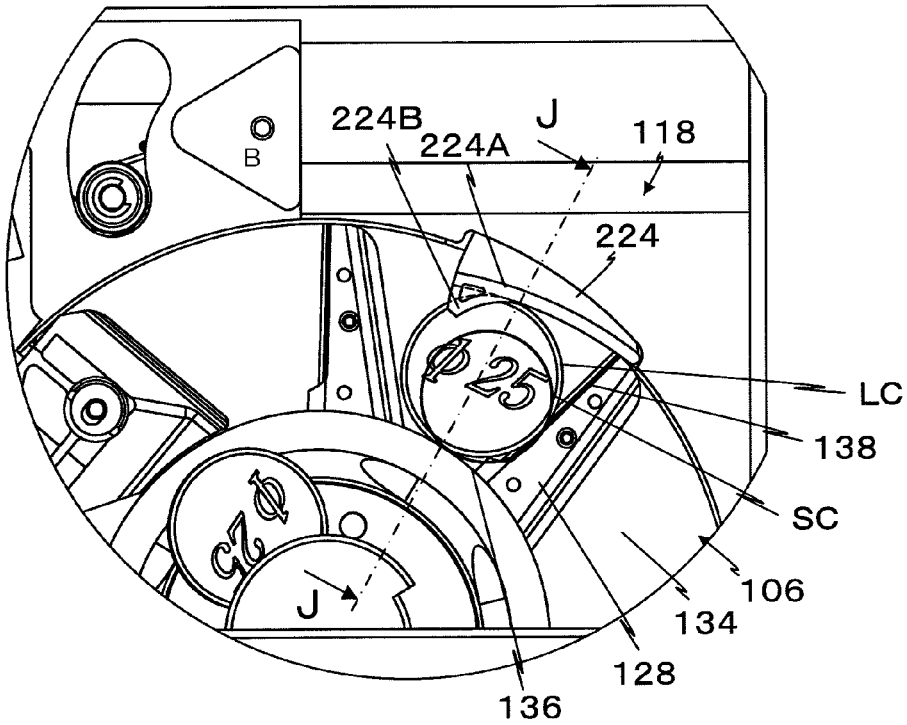
FIG. 22A is an enlarged front view of the rotating disk and a dropper according to the second embodiment of the present invention.
FIG. 22B is a cross-sectional view of the rotating disk and the dropper along line J-J in FIG. 22A.
Figure 22:
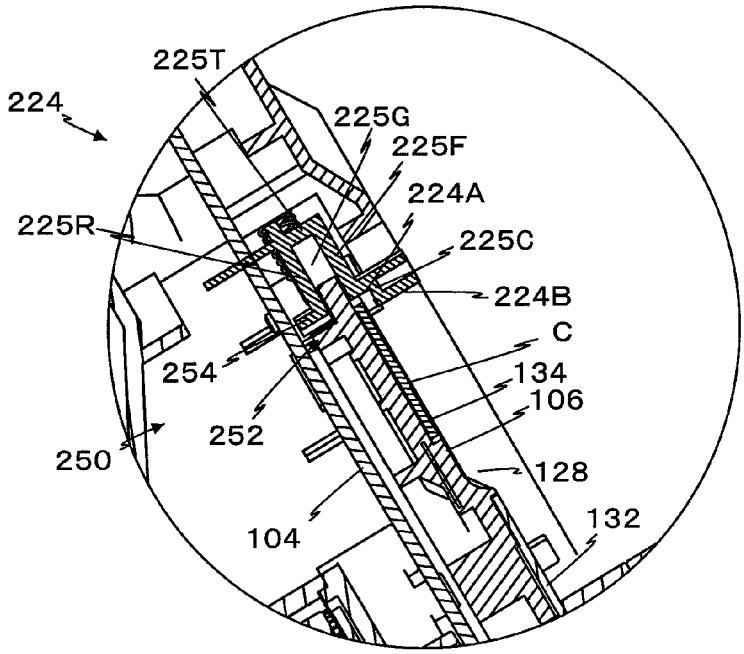

A dropper 118 according to the second embodiment of the present invention is explained next with reference to FIGS. 19, 21, 23, and 24. The dropper 118 drops into the holding bowl 102C, a coin C overlapping a coin C whose surface contacts the holding surface 134, so as to prevent overlapping coins C from reaching the receiver 112. The dropper 118 is provided upstream of a receiver 112, above a rotating shaft line of the rotating disk 106, and opposite to a periphery of the rotating disk 106. As shown in FIG. 22A, the dropper 118 is provided substantially at a two o'clock position relative to the rotating disk 106. The dropper 118 is provided proximate to the holding surface 134 of the rotating disk 106 and slidably within a parallel plane surface. Specifically, as shown in FIG. 22B, a drop lever 224 having a cross-sectionally inverted channel shape is swingably pivoted on a second fixed shaft 226, which is a pivot shaft 223 fixedly provided on an attachment base 104. The dropper 118 can thereby move reciprocally in a location proximate to the holding surface 134 of the rotating disk 106. The drop lever 224 receives a counterclockwise rotating force from a spring 236, which serves as a biasing unit 234 provided between the drop lever 224 and a spring base 104R projecting from the attachment base 104. An integrally-provided projection 238 is engaged with a stopper 240 fixedly provided on the attachment base 104, and thereby the drop lever 224 is held in a standby position SP. It is preferable that the stopper 240 be provided with an elastic material around an outer circumference thereof, so as to prevent a bounce and slapping sound caused when the projection 238 contacts.

The drop lever 224 is provided with a first circumferential pressing portion 224A and a second circumferential pressing portion 224B. As shown in FIG. 22B, the drop lever 224 is provided with a channel groove 225G, which is formed by a rear surface wall 225R, a front surface wall 225F, and a circumferential wall 225T. The rear surface wall 225R includes a longitudinally orthogonal cross section provided on a rear surface side of the rotating disk 106. The front surface 225F is provided on the holding surface 134 side at a distance narrower than the thickness of the thinnest coin. The circumferential wall 225T is provided on the rotating disk circumferential side so as to connect the rear surface wall 225R and the front surface wall 225F. The periphery of the holding surface 134 of the rotating disk 106 can proceed to the channel groove 225G. When the periphery of the rotating disk 106 is positioned at the channel groove 225G, the first circumferential pressing portion 224A and the second circumferential pressing portion 224B face the holding surface 134. In other words, the first circumferential pressing portion 224A and the second circumferential pressing portion 224B are positioned above the holding surface 134. When the first circumferential pressing portion 224A, which is an edge of the front surface wall 225F on the supporting rack 136 side, is substantially contacted externally with the rotating disk 106, the first circumferential pressing portion 224A has a crescent shape centering on the shaft center of the rotating disk 106. The first circumferential pressing portion 224A is provided in parallel relative to the rotating shaft line of the rotating disk 106, has a length corresponding to a thickness of substantially two thinnest coins, and extends upward of the holding surface 134. The second circumferential pressing portion 224B is provided farther from the holding surface 134 than the first circumferential pressing portion 224A in an end portion of the drop lever 244. The second circumferential pressing portion 224B also extends for about five times the first circumferential pressing portion 224A in parallel to the rotating shaft line of the rotating disk 106. In the present embodiment, the second circumferential pressing portion 224B is connected to the first circumferential pressing portion 224A via a connecting wall 225C. Since the second circumferential pressing portion 224B is provided closer to the supporting rack 136 than the first circumferential pressing portion 224A, the second circumferential pressing portion 224B is provided opposite to and above the holding surface 134, even when the first circumferential pressing portion 224A is pressed close to the periphery of the rotating disk 106 by coins. In order to smoothly drop coins into the holding bowl 102, the second circumferential pressing portion 224B is connected from the first circumferential pressing portion 224A by a circular edge 225P. A portion on the second fixed shaft 226 side from the circular edge 225P of the drop lever 244 is provided on an extended surface 225E of the first circumferential pressing portion 224A. In other words, the second circumferential pressing portion 224B projects downward from the extended surface 225E having a triangular pyramid shape.

As shown in FIG. 22A, the drop lever 224 is provided in the standby position SP, such that the first circumferential pressing portion 224A is provided proximate to the supporting rack 136. The position is closer to the supporting rack 136 than a diameter of a possibly largest coin LC. In other words, a periphery of the largest coin LC supported by the supporting rack 136 contacts the first circumferential pressing portion 224A, whereas a periphery of a smallest coin SC supported by the supporting rack 136 does not contact the first circumferential pressing portion 224A. Further, a coin C whose one surface contacts the holding surface 134 can pass below the second circumferential pressing portion 224B and be fed concurrently with the rotating disk 106. When the largest diameter coin LC is supported by the supporting rack 136, the first circumferential pressing portion 224A elastically contacts the periphery of the coin C and presses the coin C against the supporting rack 136. When coins C reach the drop lever 224 while bunching up together, a coin C located above a coin C at the bottom whose surface contacts the holding surface 134 is pressed toward the center of the rotating disk 106 by the second circumferential pressing portion 224B, more specifically, by the circular edge 225P, and thus drops into the holding bowl 102. However, the coin C at the bottom, whose surface contacts the holding surface 134 and whose periphery is supported by the supporting rack 136, does not drop since the coin C is supported by the supporting rack 136. Thereby, one coin C alone is in surface contact with and held by the holding surface 134 between the coin stoppers 128. When a smallest diameter coin SC reaches the drop lever 224 as the coin does not contact the supporting rack 136 due to centrifugal force, the coin is moved relatively toward the supporting rack 136 by the first circumferential pressing portion 224A. In this case, the coin C whose surface contacts the holding surface 134 is supported by the supporting rack 136, but an overlapping coin C is not supported by the supporting rack 136. Thus, the overlapping coin C is guided by a central projection 132 so as to drop into the holding bowl 102.

A retractor 250 for the dropper 118 is explained next with reference to FIGS. 22B and 12. The retractor 250 prevents the dropper 118, specifically, the first circumferential pressing portion 224A, from hitting the coin stoppers 128. The retractor 250 includes a circumferential cam 252 and a cam follower 254. The circumferential cam 252 is a cam provided on the rear surface of the rotating disk 106. The cam follower 254 is integrally provided with the drop lever 224 by projecting for a predetermined amount from the rear surface wall 225R of the drop lever 224 to the rear surface side in parallel with the rotating shaft line of the rotating disk 106.

The circumferential cam 252 is explained below. As shown in FIG. 12, the cam 252 is a circumferential cam that includes an escape portion 257, a standby portion 258, and inclined portions 260A and 260B. The escape portion 257 provided opposite to the coin stopper 128 corresponds to the diameter of the rotating disk 106. The standby portion 258 is provided between adjacent escape portions 257. The inclined portions 260A and 260B serve as a ride-on portion 259 that connects the escape portion 257 and the standby portion 258. When the drop lever 224 is positioned in the standby position SP, the cam follower 254 faces the standby portion 258 and does not contact the standby portion 258. Rotation of the rotating disk 106 concurrently rotates the cam 252, which, through the cam follower 254, swings the drop lever 224 in connection with the location of the coin stopper 128. Specifically, when the coin stopper 128 approaches, the inclined portion 260A comes into contact with the cam follower 254, which is then rotatably moved in the circumferential direction of the rotating disk 106. The cam follower 254 is further contacted with the escape portion 257. Concurrently, the drop lever 224 is moved rotatably and shifted in the circumferential direction of the rotating disk 106. Thereby, the first circumferential pressing portion 224A is prevented from hitting the coin stopper 128, and thus the durability of the coin stopper 128 is improved. When the escape portion 257 passes through, a reverse cam follower 256 is contacted with the inclined portion 260B. Then, the drop lever 224 is moved rotatably by the spring 236 toward the center of the rotating disk 106, engaged with the stopper 240 during the rotation, and held in the standby position SP. When the rotating disk 106 is rotated reversely, the reverser cam follower 256 is conversely pushed up by the inclined surface 260B and then contacted with the escape portion 257. Thus, the first circumferential pressing portion 224A does not contact the coin stoppers 128.

Figure 23:
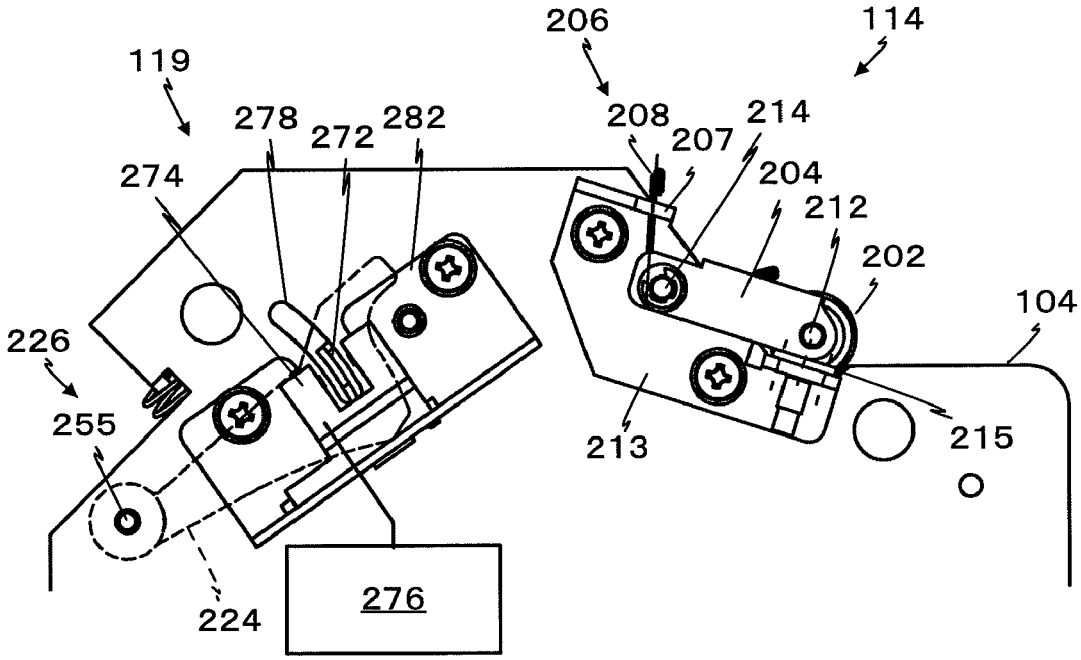
FIG. 23 is a rear view of a hopper and a rotation detector according to the second embodiment of the present invention.

A rotation detector 119 of the rotating disk 106 is explained next with reference to FIG. 23. The rotation detector 119 detects that the rotating disk 106 is rotated. The rotation detector 119 includes an operating piece 272, a sensor 274, and a determination circuit 276. The operating piece 272 extends from the rear surface wall 225R of the drop lever 224 to the rear surface side of the attachment base 104, while penetrating an elongated hole 278 in the attachment base 104. The sensor 274 detects the presence of the operating piece 272. The sensor 274 is fixedly provided on the rear surface of the attachment base 104 through a bracket 282. The sensor 274, which is provided, for example, as a transmissive-type photoelectric sensor, outputs a detection signal when the operating piece 272 blocks a projection light from a light projector, and outputs a non-detection signal when a light receiver receives a projection light. The determination circuit 276 outputs an abnormal signal when power is supplied to a motor 152 and detection and non-detection signals are not output with predetermined regularity. For instance, when no change occurs for six seconds or more from the detection signal to the non-detection signal or vice versa, the determination circuit 276 outputs the abnormal signal. When the abnormal signal is output, a regulator (not shown in the drawing), which receives the abnormal signal from the determination circuit 276, stops supplying the power to the motor 152 in order to prevent the motor 152 from being overheated.

Operations of the coin hopper 100 according to the present embodiment are explained below with reference to FIGS. 25A to 29Cii. Coins C having a diameter between 20 mm and 30 mm or coins C of one kind having a diameter within the above-described range are mixed and held in bulk in the holding bowl 102. Counterclockwise rotation of the rotating disk 106, as shown in FIG. 4, agitates coins C in a front portion of the rotating disk 106. The coins C are then stopped by the coin stoppers 128. The lower surface of the coins C stopped by the coin stoppers 128 contacts the holding surface 134. When coins C are located below the center of the rotating disk 106, the coins C tend to move toward the periphery of the rotating disk 106 due to gravity. The coins C are then directed by a circumference of an outer covering unit 102C so as to move clockwise as shown in FIG. 4. When coins C are located above the rotating shaft line of the rotating disk 106, the coins C roll toward the supporting rack 136 due to gravity. The coins C, whose lower periphery is held by the supporting rack 136, are pushed by the pressing edge 138 so as to move counterclockwise. When coins C overlap, an upper coin C is not supported by the supporting rack 136 having a height lower than a thickness of the thinnest coin, and then drops into the holding bowl 102. Thus, one coin C alone is in surface contact with and held by the holding surface 134 between the coin stoppers 128 (see FIG. 25A). Thereby, the coin C whose surface contacts the holding surface 134 is supported by the supporting rack 136, whereas the coin C placed on the contacting coin is by no means supported, and thus drops into the holding bowl 102 (see FIG. 25A). When two overlapping coins C reach the drop lever 224, the overlapping coins C can pass below the second circumferential pressing portion 244B.

Since an upper coin C is not supported by the supporting rack 136 as described above, and thus drops into the holding bowl 102 (FIGS. 29Ai to 29Cii).

When the rotating disk 106 is further rotated, the coins C reach the dropper 118. The first circumferential pressing portion 224A of the drop lever 224 contacts an outer periphery of a largest diameter coin LC that contacts the supporting rack 136 and the pressing edge 138, and the second fixed shaft 226 of the drop lever 224 is moved rotatably clockwise. Thereby, the coin C is pressed against the supporting rack 136 (see FIG. 26A).

When a small diameter coin SC is not supported by the supporting rack 136 due to centrifugal force and thus reaches the drop lever 224 (see FIG. 26A), the small diameter coin SC whose surface contacts the holding surface 134 and a small diameter coin SC placed on the contacting coin are pressed by the first circumferential pressing portion 224A of the drop lever 224 and moved toward the supporting rack 136. While the lower coin C is supported by the supporting rack 136, the upper coin C is not supported, and thus drops into the holding bowl 102 as described above.

When a coin C whose surface contacts the holding surface 134 moves concurrently with numerous coins C bunching up together and overlapping the contacting coin C, the overlapping coins C are prevented from moving by the second circumferential pressing portion 244B and drop into the holding bowl 102 on the central projection 132 side. In the present embodiment in particular, the second circumferential pressing portion 244B includes the gently curved circular edge 225P. Thus, the overlapping coins C are smoothly directed toward the central projection 132, so that the coins C drop into the holding bowl 102. Thereby, one coin C alone is fed to a coin receiver 112.

Meanwhile, the cam 252 is rotated concurrently with the rotation of the rotating disk 106. When the coin stopper 128 approaches the drop lever 224, the cam follower 254 is pushed up by the inclined surface 260B, and thus the drop lever 224 is moved rotatably in the circumferential direction of the rotating disk 106 (see FIG. 26B). Subsequently, the escape portion 257 of the cam 252 comes into contact with the cam follower 254, and the first circumferential pressing portion 224A is pushed slightly outside of the circumference of the rotating disk 106 (see FIG. 27B). When the rotating disk 106 is further rotated, the inclined surface 260A of the cam 252 faces the cam follower 254. The drop lever 224 is then pressed against the inclined surface 260A by the spring force of the spring 236, and thus the drop lever 224 is concurrently moved and rotated in the same direction. The projection 238 is engaged with the stopper 240 during the rotation, and thus the drop lever 224 is held in the standby position SP (see FIG. 26A).

When a front end of a coin C pushed by the coin stopper 128 passes the dropper 118 and comes into contact with a receiving edge 146 of a coin receiving body 145, an acute angle is formed between extended lines of the pressing edge 138 and the receiving edge 146, even in a case where a smallest diameter coin SC is held (see FIG. 29Ai). Thus, the smallest diameter coin SC is pushed by the pressing edge 138, and moved along the receiving edge 146 and then toward the periphery of the rotating disk 106. When the smallest diameter coin SC approaches an end portion 218, an upper end of the smallest diameter coin SC contacts and pushes up a hopping roller 202 (see FIG. 29Bi). When the smallest diameter coin SC contacts an apex portion of the end portion 218, the hopping roller 202 is positioned immediately before facing a diameter portion of the smallest diameter coin SC, and thus the smallest diameter coin C has yet to be sprung out. At this time, an end portion of the coin receiver 112 on the supporting rack 136 side slightly rides on a ride-on slope 142, and the receiving edge 146 starts to incline slightly relative to the holding surface 134 (see FIG. 29Bii). Since the peripheral end portion 218 is positioned away from the end portion, however, the peripheral end portion 218 substantially remains at the same location.

When the rotating disk 106 is further rotated, the diameter portion of the smallest diameter coin SC passes between the end portion 218 and the hopping roller 202. Then, the hopping roller 202 springs out the coin SC to a coin route 216, by using the spring force of a spring 208 (see FIG. 29Ci). The sprung out coin SC is discharged to a predetermined location from an outlet port 222. When the receiving edge 146 rides on the ride-on slope 142 (see FIG. 29Cii), the receiving edge 146 faces an apex portion of the coin stopper 128 and comes into contact at an acute angle (see FIG. 29Ci). The further rotation of the rotating disk 106 thus allows the receiving edge 146 to climb over the apex portion 147 of the coin stopper 128. After passing the apex portion 147 of the coin stopper 128, the receiving edge 146 comes into contact with a downward slope 149. The receiving edge 146 approaches the holding surface 134 along the downward slope 149, and then an entire length of the receiving edge 146 concurrently comes close to the holding surface 134 in a downstream edge 144. Thus, even when coins C lean against the downward slope 149, the receiving edge 146, which is positioned lower than the coins C, pushes up and drops the coins C into the holding bowl 102. Thereby, coins C are not pinched between the coin receiver 112 and the rotating disk 106. Coins C that pass through the coin route 218 are detected by the detector 116, which outputs a detection signal. The detection signal is used for counting discharged coins C and for other purposes. The operations described above apply to a case of large diameter coins.

When it is detected that the rotating disk 106 is not rotated for a predetermined time period, the rotating disk 106 is reversed. When the rotating disk 106 is reversed, the drop lever 224 is pushed up before contacting the coin stopper 128 as the reverse cam follower 256 contacts the inclined surface 260B, and then contacts the escape portion 257. Thereby, the drop lever 224 is moved concurrently, thus allowing the rotating disk 106 to rotate reversely while preventing contact with the coin stopper 128.

Figure 24:
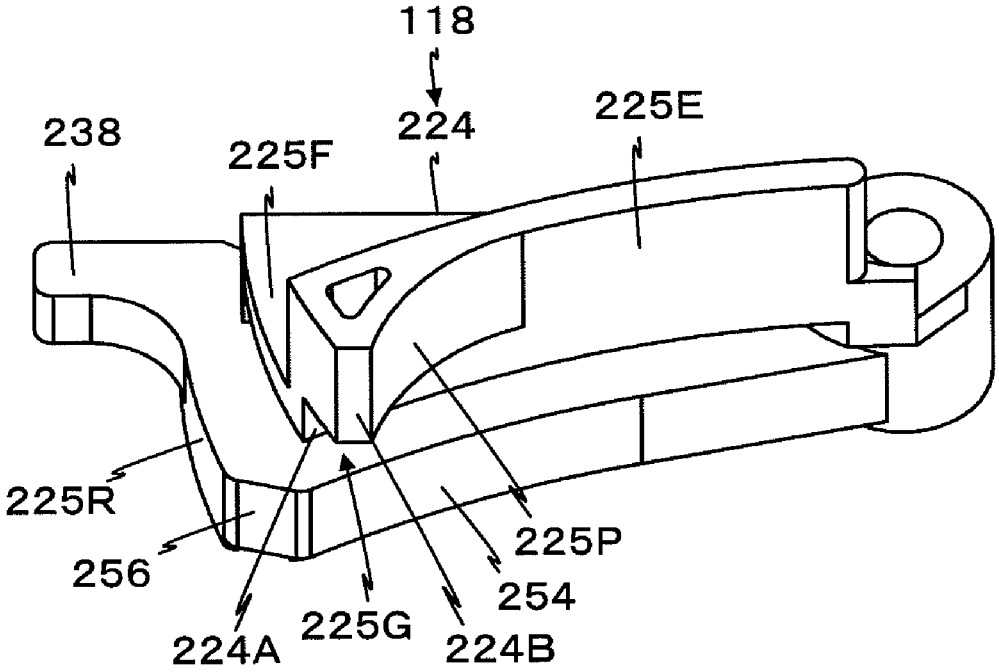
FIG. 24 is lower perspective view of a drop lever according to the second embodiment of the present invention.
Figure 25:
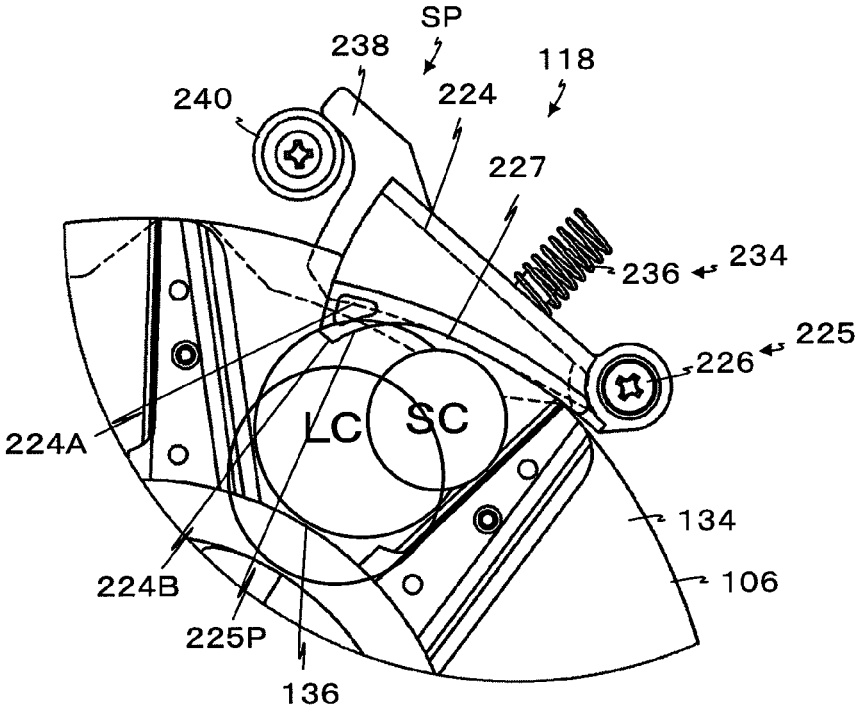
FIGS. 25A and 25B illustrate functions of a dropper according to the second embodiment of the present invention.
Figure 25:
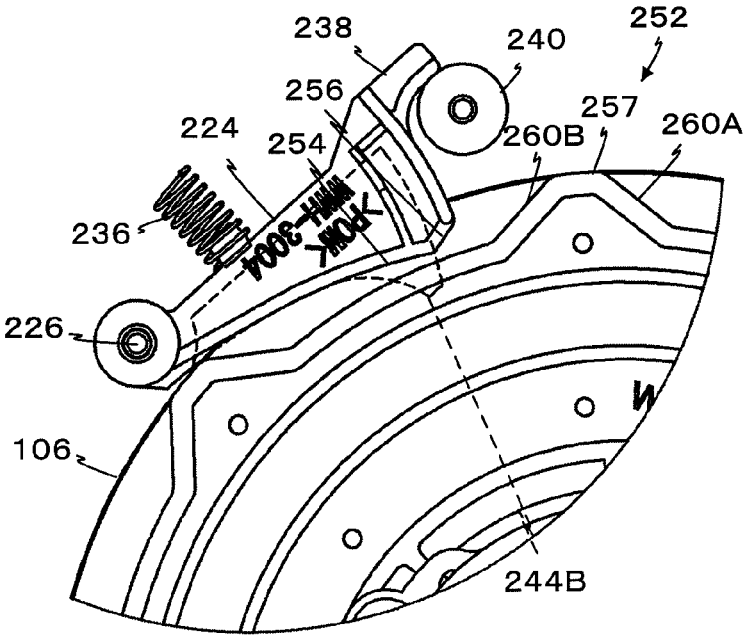
Figure 26:
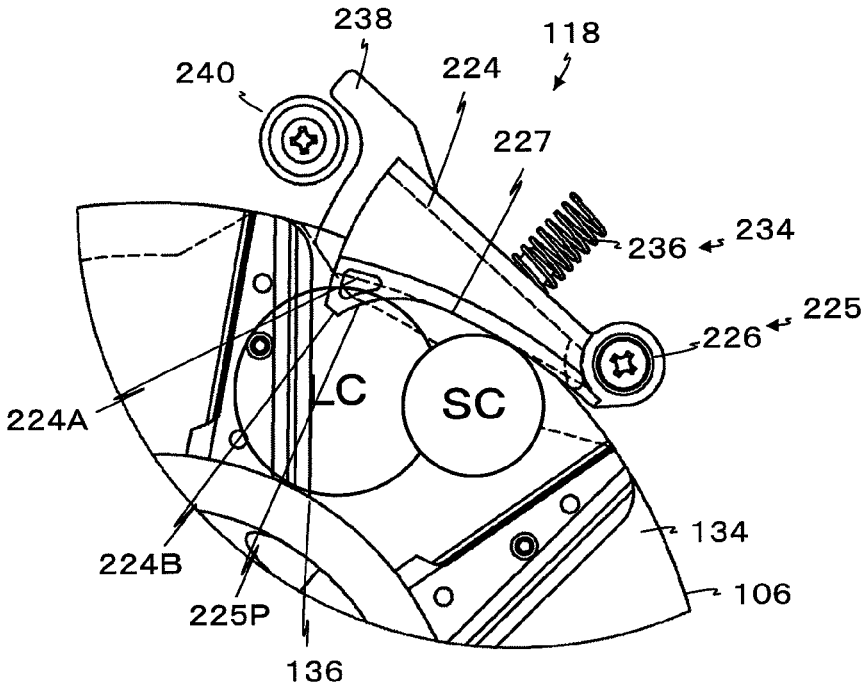
FIGS. 26A and 26B illustrate functions of the dropper according to the second embodiment of the present invention.
Figure 26:
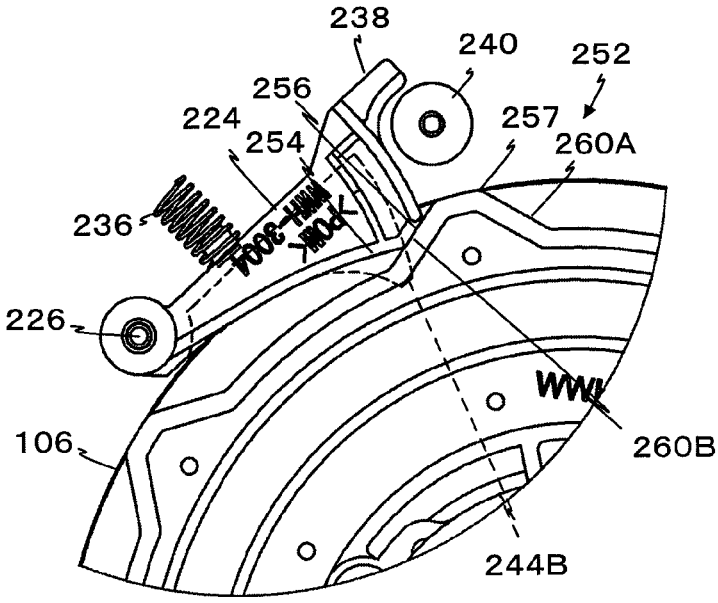
Figure 27:
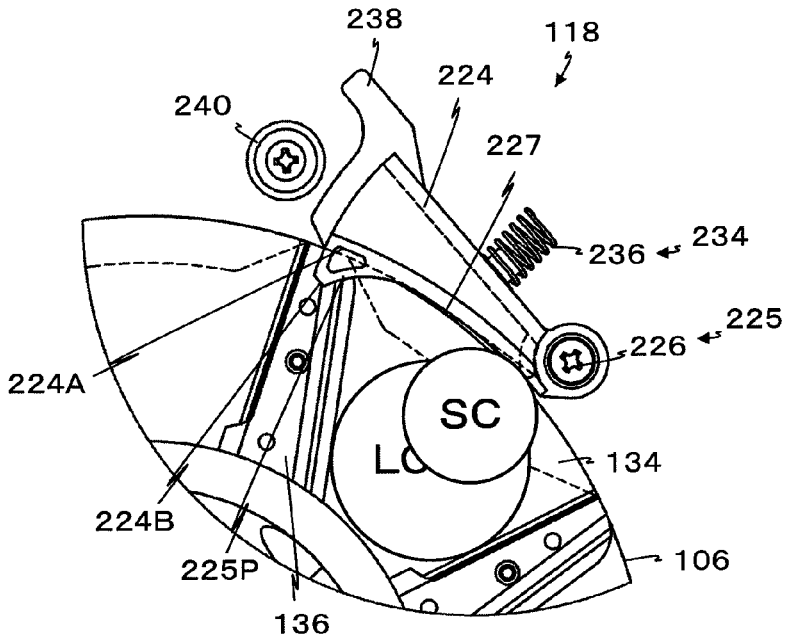
FIGS. 27A and 27B illustrate functions of the dropper according to the second embodiment of the present invention.
Figure 27:
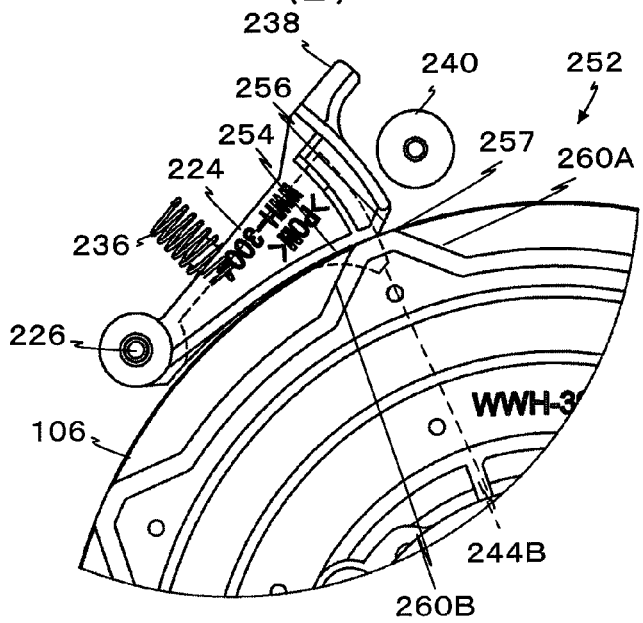
Figure 28:
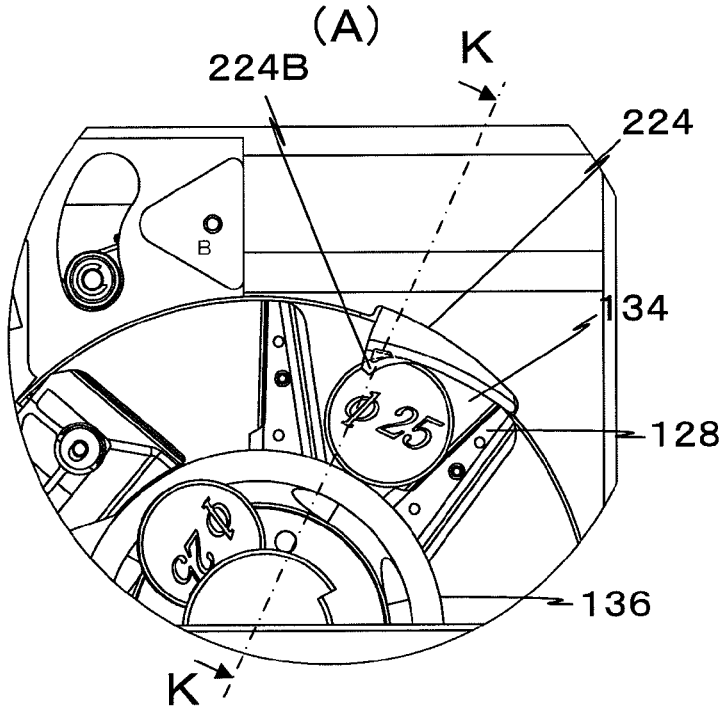
FIGS. 28A and 28B illustrate functions of the dropper according to the second embodiment of the present invention.
Figure 28:
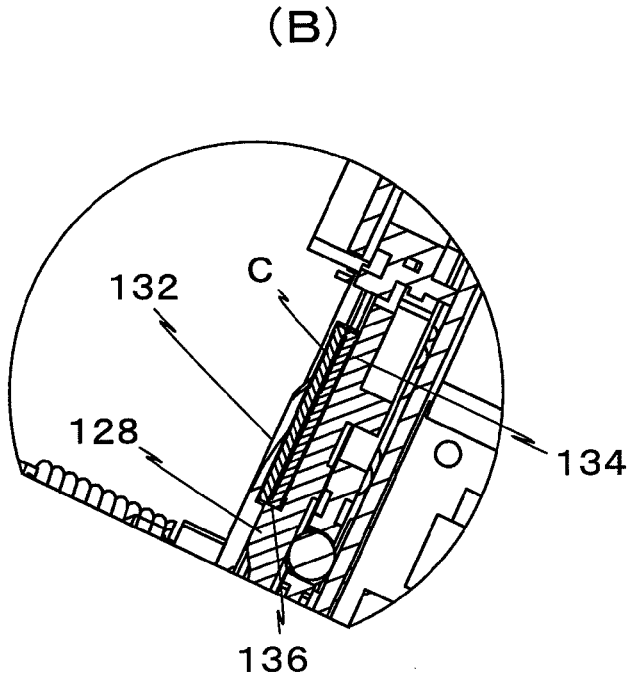
Figure 29:
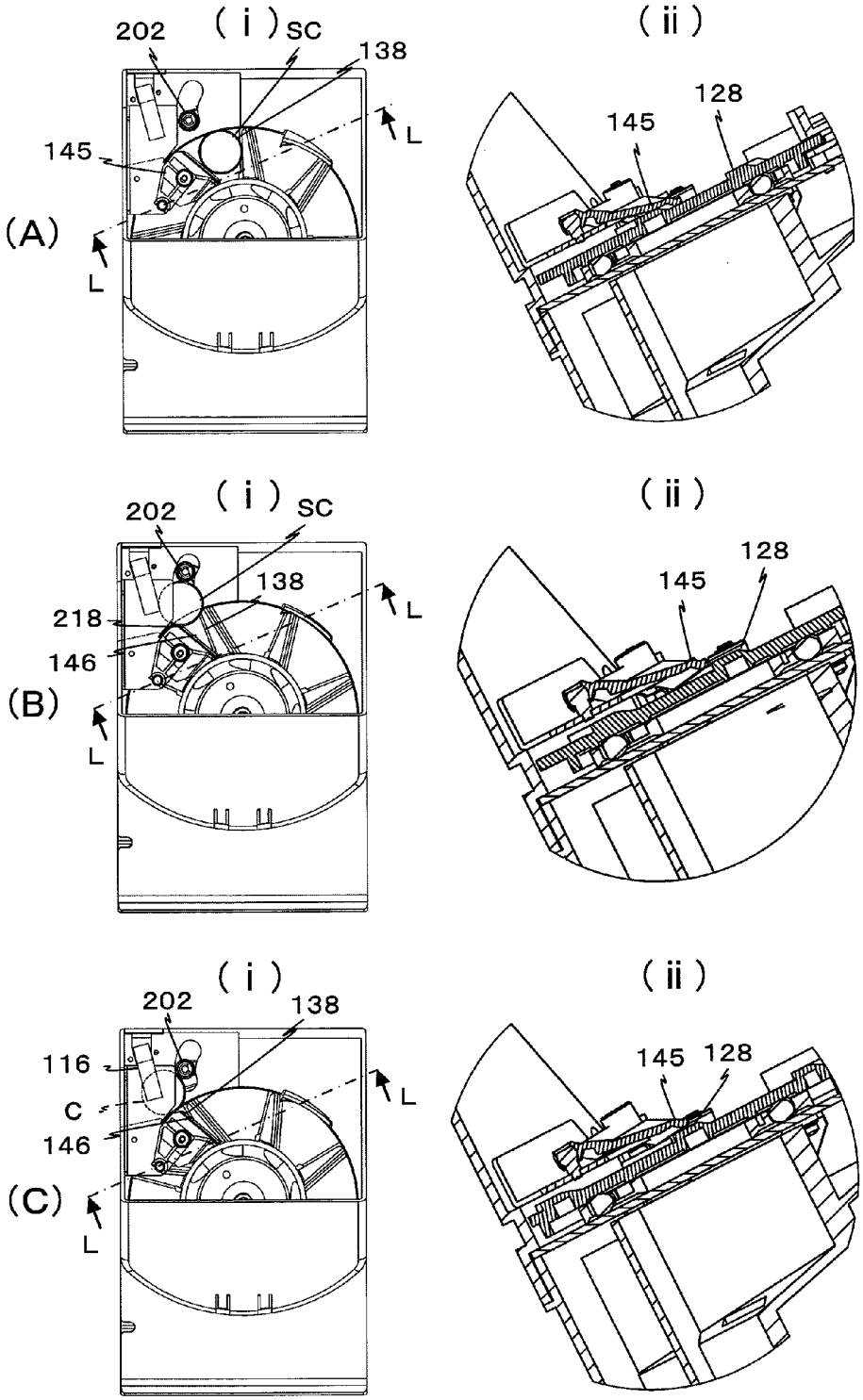
FIGS. 29Ai to 29Cii illustrate operations of a receiver according to the second embodiment of the present invention.

Operations of the rotation detector 119 are explained below. When the rotating disk 106 is rotated forward, the drop lever 224 is swung at a predetermined cycle by the escape portion 257 of the cam 252, as described above. Specifically, when the standby portion 258 faces the cam follower 254, the operating piece 272 blocks a projection light of the sensor 274, and thus the sensor 274 outputs a detection signal. When the escape portion 257 faces the cam follower 254, the operating piece 272 does not block a projection light of the sensor, since the drop lever 244 is moved rotatably counterclockwise, as shown in FIG. 24, and thus the sensor 274 outputs a non-detection signal. Accordingly, the sensor outputs detection and non-detection signals at a predetermined cycle, when the rotating disk 106 is rotated forward. When the rotating disk 106 is rotated reversely, the sensor similarly outputs detection and non-detection signals at a predetermined cycle. When the rotating disk 106 is not rotated, or rotated at substantially a low speed, the sensor does not output detection and non-detection signals at the predetermined cycle. For example, when no change occurs for six seconds or more from the detection signal to the non-detection signal or vice versa, the sensor determines that the rotation of the rotating disk 106 is abnormal and outputs an abnormal signal. The abnormal signal stops the power supply to the electric motor 152.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

What is claimed is:

1. A coin hopper comprising:

a rotating disk extending obliquely upward at a predetermined angle;

an outer covering unit covering at least a lower outer circumference of the rotating disk;

a holding bowl extending from the outer covering unit and configured to hold coins;

a circular supporting rack provided in a central region of an upper surface of the rotating disk and projecting for a thickness of substantially one of the coins;

a plurality of coin stoppers provided on the upper surface of the rotating disk and extending radially from the supporting rack in a direction circumferential to a periphery of the rotating disk at generally equal intervals, wherein the rotating disk is configured to accept the coins one by one such that a surface of each of the coins contacts a holding surface of the upper surface of the rotating disk between the plurality of coin stoppers, and wherein the rotating disk is further configured to move the coins in one direction such that a periphery of each of the coins is held by the supporting rack;

a coin receiver extending from a region of the supporting rack in the circumferential direction of the rotating disk and configured to receive the coins from the plurality of coin stoppers during movement of the coins by the rotating disk; and a dropper provided upstream of the coin receiver and configured to bias the coins toward the supporting rack above the center of the rotating disk and further configured to substantially prevent hitting the plurality of coin stoppers, wherein the dropper includes:

a first circumferential pressing portion and a second circumferential pressing portion that are unitarily provided, the first circumferential pressing portion is generally movable in parallel relative to the upper surface of the rotating disk in a space wider than a thickness of a thickest of the coins, and prevents hitting the plurality of coin stoppers, and the second circumferential pressing portion is generally movable in parallel relative to the upper surface of the rotating disk at a distance exceeding the thickness of the thickest coin and greater than the first circumferential pressing portion, and remains in a position opposite to the upper surface even when the first circumferential pressing portion is not positioned opposite the upper surface.

2. The coin hopper according to claim 1, wherein the dropper is provided integrally with a lever and has a generally planar shape, the lever being rotatably pivotable on a pivot shaft provided external to the periphery of the rotating disk, the planar shape extending generally orthogonally relative to the upper surface of the rotating disk.

3. The coin hopper according to claim 1, wherein the second circumferential pressing portion includes a generally crescent-shaped edge configured to contact a periphery of a coin supported by the rotating disk.

4. The coin hopper according to claim 1, wherein the second circumferential pressing portion includes a generally crescent-shaped edge configured to contact a periphery of a coin supported by the rotating disk.

5. A coin hopper comprising:

a rotating disk extending obliquely upward at a predetermined angle;

an outer covering unit covering at least a lower outer circumference of the rotating disk;

a holding bowl extending from the outer covering unit and configured to hold coins;

a circular supporting rack provided in a central region of an upper surface of the rotating disk and projecting for a thickness of substantially one of the coins;

a plurality of coin stoppers provided on the upper surface of the rotating disk and extending radially from the supporting rack in a direction circumferential to a periphery of the rotating disk at generally equal intervals, wherein the rotating disk is configured to accept the coins one by one such that a surface of each of the coins contacts a holding surface of the upper surface of the rotating disk between the plurality of coin stoppers, and wherein the rotating disk is further configured to move the coins in one direction such that a periphery of each of the coins is held by the supporting rack;

a coin receiver extending from a region of the supporting rack in the circumferential direction of the rotating disk and configured to receive the coins from the plurality of coin stoppers during movement of the coins by the rotating disk; and a dropper provided upstream of the coin receiver and configured to bias the coins toward the supporting rack above the center of the rotating disk and further configured to substantially prevent hitting the plurality of coin stoppers, wherein the dropper is configured to be retracted by a cam provided on the rotating disk, so as not to contact the plurality of coin stoppers.

6. The coin hopper according to claim 5, wherein the cam is a circumferential cam provided on a rear surface side of the rotating disk.

7. The coin hopper according to claim 6, wherein the cam includes an apex portion and ride-on portions, the apex portion being positioned opposite to the coin stopper and farthest from a rotation center of the rotating disk, the ride-on portions being provided on both sides of the apex portion and having substantially an equal inclination angle.

8. The coin hopper according to claim 5, further comprising a detector configured to detect a movement of the first circumferential pressing portion.

9. A coin hopper comprising:

a rotating disk extending obliquely upward at a predetermined angle;

an outer covering unit covering at least a lower outer circumference of the rotating disk;

a holding bowl extending from the outer covering unit and configured to hold coins;

a circular supporting rack provided in a central region of an upper surface of the rotating disk and projecting for a thickness of substantially one of the coins;

a plurality of coin stoppers provided on the upper surface of the rotating disk and extending radially from the supporting rack in a direction circumferential to a periphery of the rotating disk at generally equal intervals, wherein the rotating disk is configured to accept the coins one by one such that a surface of each of the coins contacts a holding surface of the upper surface of the rotating disk between the plurality of coin stoppers, and wherein the rotating disk is further configured to move the coins in one direction such that a periphery of each of the coins is held by the supporting rack;

a coin receiver extending from a region of the supporting rack in the circumferential direction of the rotating disk and configured to receive the coins from the plurality of coin stoppers during movement of the coins by the rotating disk; and a dropper provided upstream of the coin receiver and configured to bias the coins toward the supporting rack above the center of the rotating disk, and further configured to substantially prevent hitting the plurality of coin stoppers, wherein the dropper is retracted by a cam provided on the rotating disk, so as not to contact the plurality of coin stoppers, and wherein the dropper includes:

a first circumferential pressing portion and a second circumferential pressing portion that are unitarily provided, the first circumferential pressing portion is generally movable in parallel relative to the upper surface of the rotating disk in a space wider than a thickness of a thickest of the coins, and prevents hitting the plurality of coin stoppers, and the second circumferential pressing portion is generally movable in parallel relative to the upper surface of the rotating disk at a distance exceeding the thickness of the thickest coin and greater than the first circumferential pressing portion, and remains in a position opposite to the upper surface even when the first circumferential pressing portion is not positioned opposite the upper surface.

* * * * *